US007244550B2

(12) United States Patent
Fukuzawa et al.

(10) Patent No.: US 7,244,550 B2
(45) Date of Patent: Jul. 17, 2007

(54) SILVER HALIDE COLOR PHOTOGRAPHIC PHOTOSENSITIVE MATERIAL

(75) Inventors: Hiroshi Fukuzawa, Kanagawa (JP); Yutaka Maeno, Kanagawa (JP); Kazumi Nii, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 0 days.

(21) Appl. No.: 11/239,331

(22) Filed: Sep. 30, 2005

(65) Prior Publication Data

US 2006/0068339 A1 Mar. 30, 2006

(30) Foreign Application Priority Data

Sep. 30, 2004 (JP) ..... 2004-288934

(51) Int. Cl.

| | |
|---|---|
| ***G03C 1/46*** | (2006.01) |
| ***G03C 1/00*** | (2006.01) |
| ***G03C 7/00*** | (2006.01) |
| ***G03C 1/06*** | (2006.01) |

(52) U.S. Cl. ..... 430/505; 430/502; 430/503; 430/570; 430/362; 430/504; 430/264; 430/598

(58) Field of Classification Search ..... 430/502, 430/503, 567, 505, 570, 362, 504, 264, 598
See application file for complete search history.

(56) References Cited

U.S. PATENT DOCUMENTS

| | | | | |
|---|---|---|---|---|
| 4,839,268 | A | 6/1989 | Bando | |
| 5,494,789 | A | 2/1996 | Daubendiek et al. | |
| 6,656,670 | B2 | 12/2003 | Sato et al. | |
| 6,720,134 | B2 * | 4/2004 | Miyamoto et al. | 430/567 |
| 2005/0214698 | A1 * | 9/2005 | Haraguchi et al. | 430/502 |

FOREIGN PATENT DOCUMENTS

| | | | |
|---|---|---|---|
| JP | 2003-043647 | A | 2/2003 |

* cited by examiner

*Primary Examiner*—Geraldina Visconti
(74) *Attorney, Agent, or Firm*—Sughrue Mion, PLLC

(57) ABSTRACT

A silver halide color photographic photosensitive material having, on a support, at least one layer of a blue sensitive emulsion layer unit containing a yellow color forming coupler, a green sensitive emulsion layer unit containing a magenta color forming coupler, and a red sensitive emulsion layer unit containing a cyan color forming coupler, wherein 70% or more of the projection area of the entire silver halide grains has at least one layer of a silver halide photographic emulsion layer containing silver halide grains satisfying the following (a) to (c), and (1) the photosensitive material contains at least one inter-image effect providing layer, or (2) the photosensitive material contains a compound represented by the following Formula (I): (a) the material comprises a tabular silver halide host grain with an aspect ratio of 5 or more having two principal surfaces parallel with each other and a protrusion portion of silver halide epitaxially joined onto the surface of the tabular silver halide host grain, (b) the silver iodide content is 70 mole % or more both in the tabular silver halide host grains and the protrusion portion, and (c) the ratio of the silver amount of the protrusion portion to the silver amount of the tabular silver halide host grain is 12% or less Formula (I):

22 Claims, No Drawings

SILVER HALIDE COLOR PHOTOGRAPHIC PHOTOSENSITIVE MATERIAL

CROSS-REFERENCE TO RELATED APPLICATION

This application claims priority under 35USC 119 from Japanese Patent Application No. 2004-288934, the disclosure of which is incorporated by reference herein.

BACKGROUND OF THE INVENTION

1. Field of the Invention

The present invention concerns a silver halide color photographic photosensitive material having an improved granularity and color reproducibility, as well as a lower stain level after processing and stability of photographic property during storage simultaneously, and it particularly relates to a silver halide color photographic photosensitive material suitable for color reversal processing.

2. Description of the Related Art

In the color photosensitive materials, image quality and color reproducibility are important characteristics and various technical developments have been conducted for improving both of the characteristics.

In the image quality, the granularity is an important property and there is generally a trade-off relation that the granularity is more excellent but the sensitivity is lowered as the size of the photosensitive silver halide grain decreases. To this end, technique of improving the sensitivity/granularity ratio has been developed so far to obtain a higher sensitivity with an equivalent grain size or a smaller size with an equivalent sensitivity.

The technique for improving the sensitivity/granularity ratio of silver halide emulsion is generally classified into (1) increase in the light absorption amount per one grain and (2) improvement of the efficiency for utilizing absorbed light, that is, increase of the quantum sensitivity. For improving the sensitivity/granularity ratio of silver halide photosensitive materials, it is necessary to improve both of them. Since tabular silver halide grain has a shape of a larger surface area per volume and can increase an amount of spectral sensitizing dye that can be adsorbed per one grain as compared with a usual cubic or octahedral grain, it can also increase an amount of light absorption (refer, for example, to JP-A No. 59-133540). A technique of introducing dislocation has been known for improving the quantum sensitivity of the tabular grain. It is considered that since the crystal defect introduced into a grain represented by dislocation serves as a shallow electron trap for a photoelectron and prevents recombination between a photoelectron and a hole, the quantum sensitivity is improved. This technique enables to improve the quantum sensitivity of the tabular grain with large amount of light absorption and has contributed to the improvement of the sensitivity/granularity ratio in many products (refer, for example, to JP-A No. 63-220238).

On the other hand, the problem regarding the tabular grain into which dislocations are introduced is that the introduction of the dislocations hinders the improvement of the aspect ratio. Usually, dislocations are introduced into the grain by an interlayer lattice gap by forming layers having different halogen compositions in the course of crystal growth. Therefore, since steps or kinks are formed on a principal surface which was substantially smooth in terms of atoms after introducing the dislocation, the crystals are grown not only in the direction of the crystal edge but also in the direction of the crystal thickness, so that it is considered that anisotropic growing property of parallel twin tabular grain is deteriorated. Because of the reasons described above, it is difficult to increase the aspect ratio of the tabular grain into which with dislocation is introduced, resulting in hindrance of further improvement of the light absorption.

As a means for improving the quantum sensitivity without hindering the increase in the aspect ratio, a shallow internal latent image technique of covering thinly latent image forming sites with a silver halide layer (for example, refer to JP-A No. 63-158546) or a grain in which a silver halide protrusion portion is formed on a host grain having a high aspect ratio (for example, refer to JP-A Nos. 2003-15245 and 8-69069) has been known.

However, with respect to the technique described above, or the silver halide grains, particularly, silver halide emulsion containing the latter silver halide grain, although the granularity is improved, it involves a significant problem that IIE imparted from the layer to other layer is not sufficient as compared with the case of using the conventional dislocation type silver halide grain and that stains increase after the processing due to the amount of the sensitizing dye (hereinafter referred to as residual color in the invention).

With respect to the color reproducibility, various attempts have been made for improving the color reproducibility such as control of the spectral sensitivity, utilization of correction on a side absorption of a colorant by masking or utilization of an inter-image effect (IIE). Control of the IIE is particularly important as a control means to provide a desirable color reproducibility. The IIE in the color reversal photosensitive material is caused when iodide ions released from a photosensitive silver halide grains in the first development are diffused and adsorbed to silver halide grains in other layers to retard the development thereof. That is, it is desirable to increase the iodide content in the silver halide emulsion of a layer that exerts the IIE and to make the iodide content as small as possible in the layer intended to undergo the IIE. In view of this fundamental characteristic, it is difficult to control the applicability and the acceptability of the IIE independently, and therefore, difficulties arise, for example, in the case where it is intended to exerts the IIE but, at the same time, intended to be susceptible to the IIE. As measures for solving the difficulties, it has been devised to dispose a special layer for providing the IIE (IIE providing layer) (refer, for example, to JP-A No. 2002-351029). When the special layer for providing the IIE is provided, it is necessary to increase an amount of a color impurity preventing agent to be used since the color impurity occurs in the adjacent emulsion layer. Accordingly, the residue of the sensitizing dyes after the processing increases, resulting in an increase in the residual color. Further, while it has been known that the color impurity preventing agent shows the stain preventive effect as the effect of an image storability (for example, refer to JP-A No. 2003-43647 (p. 57)), the effect on the residual color due to the sensitizing dye has not yet been known.

SUMMARY OF THE INVENTION

An object of the present invention is to overcome the problems described above and provide a silver halide color photosensitive material having an excellent sensitivity and granularity, and excellent color reproducibility with less residual color after processing.

A first aspect of the present invention is to provide a silver halide color photographic photosensitive material having, on a support, each at least one layer of a blue sensitive emulsion layer unit containing a yellow color forming coupler, a green sensitive emulsion layer unit containing a magenta color forming coupler, and a red sensitive emulsion layer unit containing a cyan color forming coupler, wherein 70% or more of the projection area of the entire silver halide grains has at least one layer of a silver halide photographic emulsion layer containing silver halide grains satisfying the following (a) to (c), and the photosensitive material contains at least one inter-image effect providing layer:

(a) the material comprises a tabular silver halide host grain with an aspect ratio of 5 or more having two principal surfaces parallel with each other and a protrusion portion of silver halide epitaxially joined onto the surface of the tabular silver halide host grain, (b) the silver bromide content is 70 mole % or more both in the tabular silver halide host grain and the protrusion portion, and (c) the ratio of the silver amount of the protrusion portion to the silver amount of the tabular silver halide host grain is 12% or less.

A second aspect of the present invention is to provide a silver halide color photographic photosensitive material having, on a support, each at least one layer of a blue sensitive emulsion layer unit containing a yellow color forming coupler, a green sensitive emulsion layer unit containing a magenta color forming coupler, and a red sensitive emulsion layer unit containing a cyan color forming coupler, wherein 70% or more of the projection area of the entire silver halide grains has at least one layer of a silver halide photographic emulsion layer containing silver halide grains satisfying the following (a) to (c), and the photosensitive material contains a compound represented by the following Formula (I):

(a) the material comprises a tabular silver halide host grain with an aspect ratio of 5 or more having two principal surfaces parallel with each other and a protrusion portion of silver halide epitaxially joined onto the surface of the tabular silver halide host grain, (b) the silver bromide content is 70 mole % or more both for the tabular silver halide host grain and the protrusion portion, and (c) the ratio of the silver amount of the protrusion portion to the silver amount of the tabular silver halide host grain is 12% or less.

Formula (I)

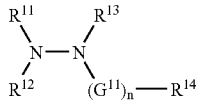

in which $R^{11}$ and $R^{12}$ each independently represent a hydrogen atom, aliphatic group or aromatic group, $R^{13}$ and $R^{14}$ each represent a hydrogen atom, or one of $R^{13}$ and $R^{14}$ represents a hydrogen atom and the other represents an alkyl group, aralkyl group, aryl group, hetrocyclic group, amino group, alkylamino group, arylamino group, alkylthio group, arylthio group, alkoxy group, aryloxy group, alkyl sulfonyl group, aryl sulfonyl group or acyl group, $G^{11}$ represents a carbonyl group, sulfonyl group, sulfinyl group, phospholyl group, oxalyl group, thiocarbonyl group, or iminomethylene group, and n represents 0 or 1.

A third aspect of the present invention is to provide a silver halide color photographic material according to the first aspect, wherein the silver halide color photographic photosensitive material contains a compound represented by the following Formula (I):

Formula (I)

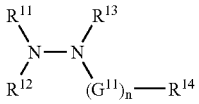

in which $R^{11}$ and $R^{12}$ each independently represent a hydrogen atom, aliphatic group or aromatic group, $R^{13}$ and $R^{14}$ each represent a hydrogen atom, or one of $R^{13}$ and $R^{14}$ represents a hydrogen atom and the other represents an alkyl group, aralkyl group, aryl group, hetrocyclic group, amino group, alkylamino group, arylamino group, alkylthio group, arylthio group, alkoxy group, aryloxy group, alkyl sulfonyl group, aryl sulfonyl group or acyl group, $G^{11}$ represents a carbonyl group, sulfonyl group, sulfinyl group, phospholyl group, oxalyl group, thiocarbonyl group, or iminomethylene group, and n represents 0 or 1.

A fourth aspect of the present invention is provide a silver halide color photographic photosensitive material according to the first aspect, wherein the silver halide color photographic photosensitive material is a silver halide color photographic photosensitive material used for forming a positive image by white and black development after imagewise exposure, followed by subjecting a residual silver halide to color forming development.

A fifth aspect of the present invention is to provide a silver halide color photographic photosensitive material according to the fourth aspect, wherein the silver iodide content in the silver halide in the inter-image effect providing layer is 1 mole % or more.

A sixth aspect of the present invention is to provide a silver halide color photographic photosensitive material according to the fifth aspect, wherein the silver halide in the inter-image effect providing layer has a spectral sensitivity to at least one wavelength region in red, green, and blue regions.

A seventh aspect of the present invention is to provide a silver halide color photographic photosensitive material according to the second aspect, wherein the silver halide color photographic photosensitive material is a silver halide color photographic photosensitive material used for forming a positive image by white and black development after imagewise exposure, followed by subjecting a residual silver halide to color forming development.

An eighth aspect of the present invention is to provide a silver halide color photographic photosensitive material according to the seventh aspect, wherein the silver iodide content in the silver halide in the inter-image effect providing layer is 1 mole % or more.

A ninth aspect of the present invention is to provide a silver halide color photographic photosensitive material as described in the eighth aspect, wherein the silver halide in the inter-image effect providing layer has a spectral sensitivity to at least one wavelength region in red, green, and blue regions.

A tenth aspect of the present invention is to provide a silver halide color photographic photosensitive material according to the third aspect, wherein the silver halide color photographic photosensitive material is (a silver halide color photographic photosensitive material) used for forming a positive image by white and black development after image-wise exposure, followed by subjecting a residual silver halide to color forming development.

An eleventh aspect of the present invention is to provide a silver halide color photographic photosensitive material as described in the tenth aspect, wherein the silver iodide content in the silver halide in the inter-image effect providing layer is 1 mole % or more.

A twelfth aspect of the present invention is to provide a silver halide color photographic photosensitive material as described in the eleventh aspect, wherein the silver halide in the inter-image effect providing layer has a spectral sensitivity to at least one wavelength region in red, green, and blue regions.

DETAILED DESCRIPTION OF THE INVENTION

Next, the present invention will be described more specifically.

In the silver halide emulsion of the invention, the silver halide grains comprising tabular silver halide host grains with an aspect ratio of 5 or more having two principal surfaces parallel with each other (hereinafter referred to as "host tabular grain" or "host grain") and a protrusion portion of silver halide epitaxially joined onto the surface of the host grain (hereinafter referred to as "silver halide protrusion" or "protrusion") occupy 70% or more of the projection area of the entire silver halide grains. It is further preferred that the silver halide grains occupy 80% or more of the entire projection area and most preferably 90% or more of the entire projection area. The protrusion portion is a portion protruded relative to the host grain which can be confirmed by an electron microscopic observation.

The host tabular grain comprises two principal surfaces which are parallel to each other and side faces joining these two principal surfaces. A shape of each of the principal surfaces may be any one of an arbitrary polygon, a circle, an ellipsoid or the like encompassed by a straight line, a shape contoured by an undefined curve and a shape contoured by a combination of a straight line and a curve and, preferably the shape has at least one apex. Further, more preferably, it is any one of a triangle having three apexes, a quadrangle having four apexes, a pentagon having five apexes, a hexagon having six apexes, or combinations thereof. The term "apex" as used herein is intended to indicate an angle which is formed by two adjacent sides and is not round. When the angle is roundish, a point at which a length of a curved portion is bisected is defined as an apex.

Any type of crystal structures of the principal surface of the host tabular grain can be used. That is, the crystal structure of the principal surface may be any one of a (111) plane, a (100) and a (110) plane, or a high-order plane, and most preferred embodiment is a tabular grain in which the principal surface is a (111) plane or a (100) plane. In the case of the tabular grain in which the principal surface is the (111), an embodiment in which the grains each having the principal surface in a shape of hexagon having six apexes is 70% or more of the entire projected area of grains is preferred. Further, in the case of the tabular grain in which the principal surface is the (100), an embodiment in which the grains each having the principal surface in a shape of a quadrangle having four apexes is 70% or more of the entire projected area of grains is preferred.

The host tabular grain of the present invention has an aspect ratio of 5 or more, the aspect ratio being obtained by dividing an equivalent-circle diameter of grain by the thickness of the grain. The aspect ratio is preferably in the range of from 5 to 200, more preferably in the range of from 10 to 200 and, most preferably, in the range of from 15 to 200. The equivalent-circle diameter of a grain refers to the diameter of a circle having the same area as the projected area of the principal surface of the grain.

The equivalent-circle diameter of the host tabular grain can be obtained by first taking a transmission electron microscopic photograph by using a replica method and, next, obtaining a projected area of each grain by performing photographing magnification correction thereto and, then, converting the thus-obtained projected area into an equivalent-circle diameter. Although there is a case in which the thickness of grain cannot be calculated from the length of a shadow of a replica in a simple manner due to epitaxial deposition, the thickness thereof can be calculated by measuring the length of the shadow of the replica prior to the epitaxial deposition. Alternatively, even after the epitaxial deposition, the thickness thereof can easily be obtained by cutting a sample coated with an emulsion, and, taking an electron microscopic photograph of the cross-section of the cut sample.

The equivalent-circle diameter of the host tabular grain of the present invention is preferably in the range of from 0.5 μm to 10.0 μm and, more preferably, in the range of from 0.7 μm to 10.0 μm. Further, the thickness of grain is, preferably, in the range of from 0.02 μm to 0.5 μm, more preferably in the range of from 0.02 μm to 0.2 μm and, most preferably, in the range of from 0.03 μm to 0.15 μm.

In the host tabular grain of the present invention, a variation coefficient of the equivalent-circle diameter among grains is, preferably, 40% or less, more preferably 30% or less and, particularly preferably, 25% or less. The term "variation coefficient of the equivalent-circle diameter among grains" as used herein means a value as defined by dividing the standard deviation of distribution of the equivalent-circle diameters of grains by an average equivalent-circle diameter, and by multiplying the obtained quotient by 100.

In the present invention, the silver halide protrusion portion is formed at an arbitrary position on a surface of the host tabular grain by the epitaxial junction. The position of forming the protrusion portion may be on a principal surface, on an apex portion or on a side except for the apex portion of the host tabular grain and, most preferably, on the apex portion thereof. The term "apex portion" as used herein is referred to as a portion within a circle having a diameter of one third of a length of a shorter side between two sides adjacent to an apex, when the tabular plane is viewed from the direction perpendicular to the principal surface. Specifically, an embodiment in which silver halide grains in which the protruded portions are present on all of the apexes on the principal surfaces of the host tabular grains are 70% or more of the entire projected area, is preferable, an embodiment in which such silver halide grains are 80% or more thereof is more preferable and an embodiment in which such silver halide grains are 90% or more thereof is still more preferable.

An amount of silver in the silver halide protrusion portion in the epitaxial junction tabular grain is characterized by a ratio of 12% or less relative to the amount of silver of the host tabular grain. The ratio of the amount of silver is, more preferably, in the range of from 0.5% to 10% and, still more preferably, in the range of from 1% to 8%. When the amount of silver is too small, a repeating reproducibility of an epitaxial formation is deteriorated, while, when the amount of silver is too large, problems are caused such that sensitivity is reduced or granularity is deteriorated. Further, a ratio of the silver halide protrusion portion present on the surface of the grain is preferably 50% or less and, more preferably, 20% or less, relative to the surface of the host tabular grain.

The silver halide protrusion portion of the present invention contains preferably a pseudo halide. The term "pseudo halide" as used herein is referred, as described in JP-A No. 7-72569, to as a group of compounds known as having similar properties as those of a halide (namely, capable of providing sufficiently electrically negative monovalent anion groups at least exhibiting the same positive Hammett sigma value as that of the halide, such as $CN^-$, $OCN^-$, $SCN^-$, $SeCN^-$, $TeCN^-$, $N_3^-$, $C(CN)_3^-$ and $CH^-$). The pseudo halide content of the protrusion portion is preferably 0.01 to 10% by mole relative to the silver amount of the protrusion portion, and more preferably, 0.1 to 7% by mole.

In the silver halide grains of the present invention, the halide composition of the host grains and the protrusion portions is pure silver bromide, or silver iodobromide, silver chlorobromide, or silver chloroiodobromide having a silver bromide content of 70% by mole or more. When the content is less than 70% by mole, an increase in fog after storage becomes large, which is problematic. The silver bromide content is preferably 80% by mole, and more preferably, 90% by mole or more.

In the silver halide grain of the present invention, an average silver iodide content of all the grains is preferably 20% by mole or less, more preferably 15% by mole or less and, most preferably, 10% by mole or less. When the silver iodide content exceeds 20% by mole, a sufficiently high sensitivity cannot be obtained. An embodiment in which the average silver iodide content of the protrusion portion is lower than that of an outer-shell-8%-region (relative to the silver amount of the host grain) of the host grain is preferred. The term "outer-shell-8%-region of the host grain" as used herein means a layered region toward the center from the surface of the host grain in which the silver amount is 8% with respect to the total silver amount of the host grain.

In the silver halide grains of the present invention, the silver chloride content of each of the host grains and the protrusion portions is preferably 8% by mole or less, more preferably 4% by mole or less, and most preferably, 1% by mole or less.

In the silver halide grains of the present invention, the distribution of the silver iodide content among the grains is preferably a monodisperse. More specifically, assuming that an average silver iodide content of all the grains is I mole %, an embodiment in which 70% or more of the total projected area of the grains is occupied by the silver halide grains having a silver iodide content within the range of 0.6I to 1.4I, is preferable. An embodiment in which 70% or more of the total projected area of the grains is occupied by the silver halide grains having a silver iodide content within the range of 0.7I to 1.3I is more preferable.

Next, the inter-image effect providing layer of the invention (hereinafter referred to as an IIE providing layer) will be described.

The color photographic photosensitive material of the invention has at least one layer of the IIE providing layer containing a silver halide emulsion capable of providing an inter-image effect by incorporation of silver iodide. The silver halide emulsion contained in the IIE providing layer may be photosensitive or non-photosensitive and is preferably a silver halide containing one mole % or more of silver iodide and, more preferably, silver halide containing 10 mole % or more of silver iodide. So long as the silver halide emulsion contained in the IIE providing layer is a silver halide containing one mole % or more of silver iodide, there is no particular restriction of other halide composition. Silver bromoiodide containing 10 mole % or more of silver iodide is preferred. Further, the coating amount of silver in the inter-image effect providing layer is, preferably, from 0.1 to 1.0 g/m$^2$ and, more preferably, from 0.2 to 0.7 g/m$^2$.

As the spectral sensitivity of the IIE providing layer of the invention, a red sensitive layer, a green sensitive layer or a blue sensitive layer may be considered. The color photographic photosensitive material of the invention contains at least one type of IIE providing layers described above and it preferably contains two types, that is, a red sensitive layer and a green sensitive layer and, more preferably, contains three types, that is, a red sensitive layer, a green sensitive layer, and a blue sensitive layer.

There is a preferred range of the gravitational center of the spectral sensitivity distribution of the three types of IIE providing layers. The gravitational center wavelength of the spectral sensitivity distribution of the red sensitive IIE providing layer ($\lambda ir$) is preferably from 580 nm to 700 nm, the gravitational center wavelength of the spectral sensitivity distribution of the green sensitive IIE providing layer ($\lambda ig$) is preferably from 500 nm to 570 nm, and the gravitational center wavelength of the spectral sensitivity distribution of the blue sensitive IIE providing layer ($\lambda ib$) is preferably from 400 nm to 470 nm. $\lambda ir$, $\lambda ig$ and $\lambda ib$ can be calculated according to the following equations.

$$\lambda ir = \int_{500}^{700} \lambda \cdot Sr(\lambda)\, d\lambda \Big/ \int_{500}^{700} Sr(\lambda)\, d\lambda$$

$$\lambda ig = \int_{500}^{700} \lambda \cdot Sg(\lambda)\, d\lambda \Big/ \int_{500}^{700} Sg(\lambda)\, d\lambda$$

$$\lambda ib = \int_{400}^{550} \lambda \cdot Sb(\lambda)\, d\lambda \Big/ \int_{400}^{550} Sb(\lambda)\, d\lambda$$

in which $Sn(\lambda)$ represents a spectral sensitivity distribution of each color sensitive layer to form a developed color density of 1.0, and in the case where the photosensitive emulsion layer does not form a color, the $Sn(\lambda)$ is obtained by silver—developing a sample coated with a single layer of the emulsion and using the result of the spectral response which gives a black silver density of 0.2. n represents r, g or b.

The wavelength at gravitational center of the spectral sensitivity distribution often corresponds to an absorption wavelength by a J-aggregate of a spectral sensitizing dye adsorbed to grains in the emulsion, and often coincides with a wavelength which gives the maximum value of the spectral sensitivity distribution.

Preferably, the IIE providing layer does not substantially form an image, and may contain a coupler. In this case, however, the amount of the coupler is preferably ⅕ mole % or less and, more preferably, 1/10 mole % or less based on the total amount of couplers contained in each of the red sensitive, green sensitive, and blue sensitive silver halide emulsion layers.

In the color photosensitive material of the invention preferably, the gravitational center wavelength of a spectral sensitivity distribution represented by a cyan image, namely, the spectral sensitivity distribution of the red sensitive silver halide emulsion layer containing a cyan color-forming coupler is preferably 580 nm or more and 630 nm or less, and more preferably, 590 nm or more and 620 nm or less. Further, the gravitational center wavelength of the spectral sensitivity distribution represented by a magenta image, namely, the spectral sensitivity distribution of the green sensitive silver halide emulsion layer is preferably 520 nm or more and 560 nm or less, and more preferably 530 nm or more and 550 nm or less.

The green sensitive inter-image effect providing layer and the red sensitive inter-image effect providing layer can be disposed at an optional position, and they are preferably disposed near the red sensitive layer. In a case of a common structure of a photosensitive material in which the blue sensitive layer is disposed at the furthest position from the support, the green sensitive layer is disposed next, and the red sensitive layer is disposed nearest to the support, it is preferred that the green sensitive inter-image effect providing layer and the red sensitive inter-image effect providing layer are disposed nearer to the support than the blue sensitive layer, further preferably disposed nearer to the support than the green sensitive layer, and more preferably disposed between the red sensitive layer and the support, and most preferably they are arranged in the order of the red sensitive layer, the red sensitive inter-image effect providing layer, the green sensitive inter-image effect providing layer, and the support. It is preferred that an undercoat layer and an anti-halation layer are disposed in this order from the side nearer to the support between the green sensitive inter-image effect providing layer and the support.

The blue sensitive inter-image effect providing layer is preferably disposed farther away from the support than the yellow filter layer. Most preferably, a low sensitivity blue sensitive layer, a blue sensitive inter-image effect providing layer and a yellow filter layer are disposed in this order from the side farther from the support.

It is preferable to provide an intermediate layer in the IIE providing layers and/or between the IIE providing layer and another color sensitive layer. In the intermediate layer, it is preferable to use a competitive compound (compound that reacts with an oxidized product of a color forming developer while competing with an image forming coupler and not forming an dye image) in combination. Examples of the competitive compound include reducing compounds such as hydroquinones, catechols, hydrazines, or sulfonamide phenols, or a compound that couples with an oxidized product of a color developer, but substantially not forming a color image (for example, non-color forming couplers as disclosed in German Patent No. 1,155,675, British Patent No. 861,138, and U.S. Pat. Nos. 3,876,428, and 3,912,513 or couplers in which a developed color dye effuses into a processing solution during processing as disclosed in JP-A No. 6-83002). The addition amount of the competitive compound is from 0.01 g to 10 g and, preferably, from 0.10 g to 5.0 g per 1 $m^2$ of the photosensitive material.

Next, the compound represented by Formula (I) will be explained more specifically.

The aliphatic groups represented by $R^{11}$ and $R^{12}$ are preferably those having 1 to 30 carbon atoms, particularly, a linear, branched or cyclic alkyl group having 1 to 20 carbon atoms. The branched alkyl group may be cyclized so as to form a saturated hetero ring containing one or more of hetero atoms therein. The alkyl group may have a substituent such as an aryl group, alkoxy group, sulfinyl group, sulfonamide group, and carbonamide group.

They include, for example, t-butyl, n-octyl, t-octyl, cyclohexyl, pyrrolidyl, imidazolyl, tetrahydrofuryl, and morpholinyl.

In Formula (I), the aromatic groups represented by $R^{11}$ and $R^{12}$ include a hetero cyclic group condensed with a monocyclo or bicyclo aryl group. In this case, the unsaturated heterocyclic group may be condensed with a monocyclic or bicyclic aryl group, to form a heteroaryl group.

They include, for example, a benzene ring, naphthalene ring, pyridine ring, pyrimidine ring, imidazole ring, quinoline ring, iquinoline ring, benzimidazole ring, thiazole ring, and benzothiazole ring. Among them, those containing a benzene ring are preferred. An aryl group is particularly preferred.

The aryl group or unsaturated heterocyclic group represented by $R^{11}$ and $R^{12}$ may have a substituent. Typical substituents include, for example, an alkyl group, aralkyl group, alkoxy group, aryl group, substituted amino group, acylamino group, sulfonyl amino group, ureido group, urethane group, aryloxy group, sulfamoyl group, carbamoyl group, alkylthio group, arylthio group, sulfonyl group, sulfinyl group, hydroxyl group, halogen atom, cyano group, sulfo group or carboxyl group.

The alkyl group represented by $R^{11}$ is, preferably, an alkyl group having 1 to 30 carbon atoms, which may be linear, branched or cyclic. Specifically, they include, for example, methyl, ethyl, butyl, t-butyl, cyclohexyl, octyl, dodecyl or octadecyl. The aralkyl group, preferably, includes those having 7 to 30 carbon atoms, and specifically they include, for example, benzyl, phenetyl and naphthylmethyl. The aryl group preferably includes those having 6 to 30 carbon atoms, and specific examples thereof include phenyl and naphthyl. The heterocyclic groups include preferably those having 1 to 12 carbon atoms and specific examples thereof include imidazolyl, and pyridyl. The alkoxy groups include, preferably, those having 1 to 30 carbon atoms, and specific examples thereof include phenoxy, and naphthyloxy groups. The amino groups include preferably those having 0 to 30 carbon atoms. Specifically, they include non-substituted amino, alkylamino, arylamino, methylamino and phenylamino. The alkoxycarbonyl groups include preferably those having 1 to 30 carbon atoms, and specifically they include ethoxycarbonyl, octyloxycarbonyl, dodecyloxycarbonyl and benzyloxycarbonyl. The aryloxycarbonyl groups include preferably those having 6 to 30 carbon atoms, and specifically include phenoxycarbonyl and naphthyl carbonyl. The carbamoyl groups include preferably those having to 30 carbon atoms, and specifically they include, for example, carbamoyl, N,N-diethylcarbamoyl, and phenylcarbamoyl. The acyl groups include preferably those having 1 to 30 carbon atoms, and specifically they include acetyl, octanoyl, cyclohexylcarbonyl, octadecanoyl, benzoyl, nicotinoyl and thenoyl. The alkyl group, aralkyl group, aryl group, heterocyclic group and alkoxy group represented by $R^{13}$ and $R^{14}$, respectively, include those described as the groups for $R^{11}$, and preferable groups are also the same as described those for $R^{11}$. The alkylamino groups having 1 to 30 carbon atoms are preferable, and include, for example, methylamino group, n-butylamino group, t-octylamino group, cyclohexylamino group, octadecylamino group, N,N-dimethylamino group, N-methyl-N-octylamino group. The arylamino groups having 6 to 30 carbon atoms are preferable, and include, for example, phenylamino group, N-methyl-N-phenylamino group and naphthylamino group. The alkylthio groups having 1 to 30 carbon atoms are preferable, and include, for example, methylthio group, n-butylthio group, t-octylthio group, cyclohexylthio group and octadecylthio group. The arylthio groups having 6 to 30 atoms are preferable, and include, for example, phenylthio group and naphthylthio group. The aryloxy groups having 6 to 30 atoms are preferable, and include, for example, phenoxy group and naphthoxy group. The groups represented by $G^{11}$ preferably include a carbonyl group and sulfonyl group, and among carbonyl group is more preferable.

$R^{14}$ may have a substituent, and specifically include those described above as the substituents for $R^{12}$.

The compound represented by Formula (I) of the invention is preferably non-diffusible, and has a molecular weight of 300 per>N-N<or more and 20,000 or less, preferably, 400 or more and 1,200 or less and, more preferably, 450 or more and 800 or less.

Among those represented by Formula (I), preferred are those represented by

Formula (II)

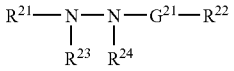

where $R^{21}$, $R^{22}$ and $G^{21}$ are identical, respectively, with those described for $R^{11}$, $R^{14}$ and $G^{11}$, and $R^{23}$ and $R^{24}$ each represent a hydrogen atom or one of $R^{23}$ and $R^{24}$ represents a hydrogen atom and the other represents an alkylsulfonyl group, an arylsulfonyl group, or an acyl group.

More specifically, $R^{21}$ may be substituted with a substituent, and the substituents specifically include those identical with the substituents for $R^{11}$, $R^{12}$, $R^{13}$ and $R^{14}$ in Formula (I), and particularly preferred are a ureido group, alkoxy group, alkyl group, acylamino group, substituted amino group, sulfonylamino group, urethane group, and aryloxy group. The substituents may possibly be bonded to form a ring. $R^{21}$ is preferably an aromatic group, aromatic hetero ring or aryl-substituted methyl group, an aryl group being more preferred.

Among groups represented by $R^{22}$, preferred are a hydrogen atom, an alkyl group (for example, methyl), aryl group (for example, 2-hydroxymethylphenyl), aralkyl group (for example, hydroxybenzyl). Examples of the substituents for $R^{22}$ include substituents described for the $R^{11}$, $R^{12}$, $R^{13}$ and $R^{14}$, as well as an acyl group, acyloxy group, alkyl or aryloxycarbonyl group, alkenyl group, alkinyl group, sulfonyl group, cyano group, halogen atom, or nitro group may also be applicable. Those substituents may further substituted with the substituents described above. Those groups may be joined together to form a ring.

At least one of $R^{21}$ and $R^{22}$ is preferably incorporated with a ballast group which is customarily used in an immobile photographic additive such as a coupler. The ballast group is relatively a photographically inert group having 8 or more carbon atoms, and can be selected from, for example, an alkyl group, alkoxy group, phenyl group, alkylphenyl group, phenoxy group, alkylphenoxy group, alkylcarbonyloxy group, alkoxycarbonyl group, ether group, amido group, ureido group, urethane group, sulfonamide group, thioether group, sulfonyl group, acyl group, and combinations of such groups. The total of the number of carbon atoms of $R^{21}$ and $R^{22}$ is preferably 13 or more, and more preferably 20 to 60 carbon atoms. Preferably, the substituents for $R^{21}$ and $R^{22}$ do not contain a dissociative group.

$R^{23}$ and $R^{24}$ each represent a hydrogen atom, an alkylsulfonyl group and an arylsulfonyl group of 20 or less carbon atoms (preferably, a phenylsulfonyl group or a substituted phenylsulfonyl group such that the sum of the Hammett's substituent constant ($\sigma_p$) is −0.5 or more), an acyl group of 20 or less carbon atoms (preferably a benzoyl group or a benzoyl group substituted so that the sum of the Hammett's substituent constant is −0.5 or more, or a linear, branched or cyclic, unsubstituted or substituted aliphatic acyl group). The substituents include a halogen atom, an ether group, sulfoneamide group, and carboneamide group. As $R^{23}$ or $R^{24}$, a hydrogen atom is most preferred.

The groups represented by $-G^{21}-R^{22}$ include, for example a formyl group, acyl group (for example, acetyl, propionyl, trifluoroacetyl, chloroacetyl, benzoyl, 4-chlorobenzoyl, pyruvoyl, 2-hydroxymethylbenzoyl), methoxalyl group (methyloxamoyl), ethoxalyl group (ethyloxamoyl), alkylsulfonyl group (methanesulfonyl, 2-chloroethanesulfonyl), arylsulfonyl group (benzenesulfonyl), alkylsulfinyl group (methanesulfinyl), arylsulfinyl group (benzenesulfinyl), carbamoyl group (methylcarbamoyl, phenylcarbamoyl), sulfamoyl group, (dimethylsulfamoyl), alkoxycarbonyl group (methoxycarbonyl, methoxyethoxycarbonyl, methoxyethoxyethoxycarbonyl), aryloxycarbonyl group (phenoxycarbonyl), sulfamoyl group (methylsulfamoyl), alkoxysulfonyl (methoxysulfonyl, ethoxysulfonyl), thioacyl group (methylthiocarbonyl), thiocarbamoyl group (methylthiocarbamoyl), or hetero ring group (piridyl). Particularly preferred are a formyl group, acyl group and heterocyclic group.

Specific examples of the compound represented by Formula (I) will be described below. However, the invention is not limited to the compounds described below.

(I-1)

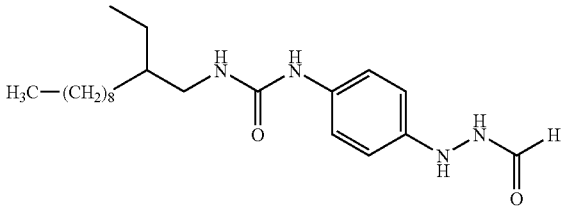

-continued
(I-2)
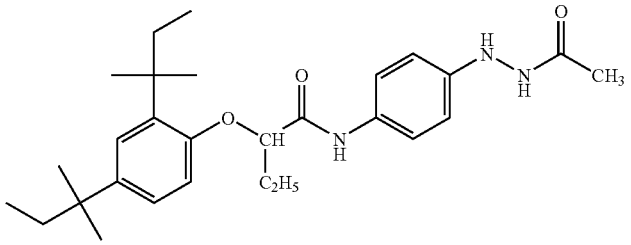
(I-3)
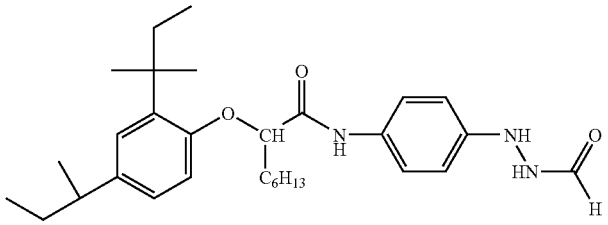
(I-4)
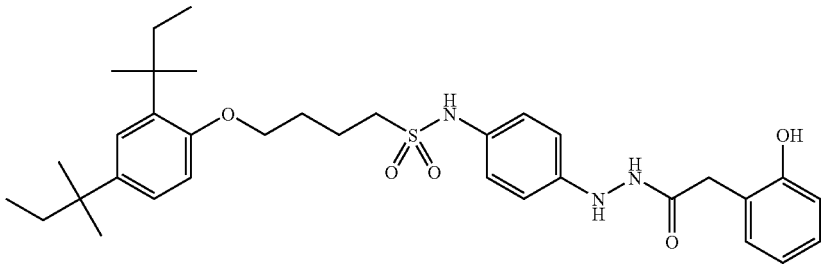
(I-5)
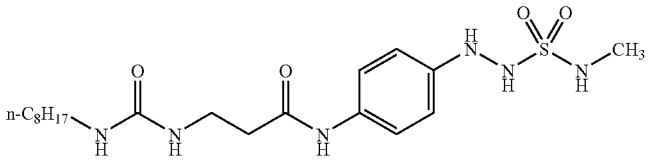
(I-6)
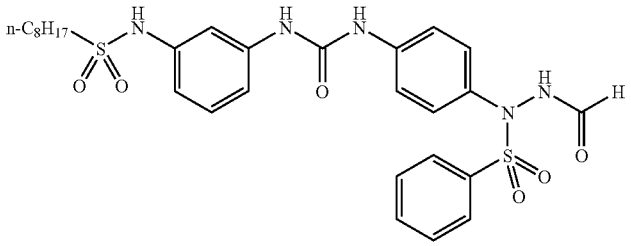
(I-7)
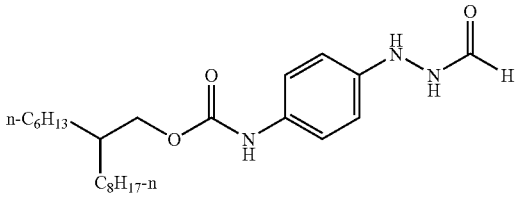

-continued
(I-8)
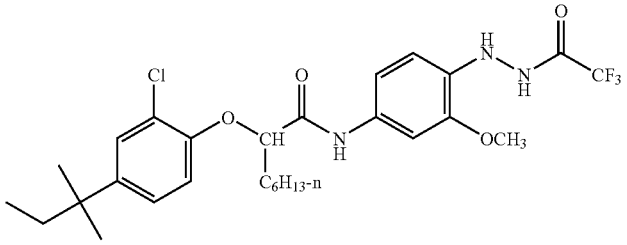
(I-9)
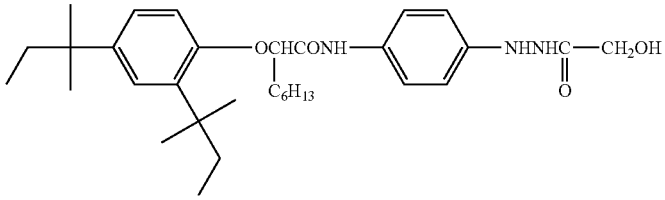
(I-10)
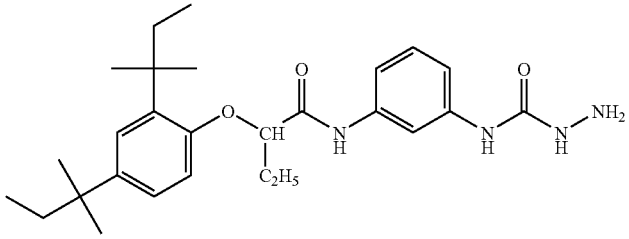
(I-11)
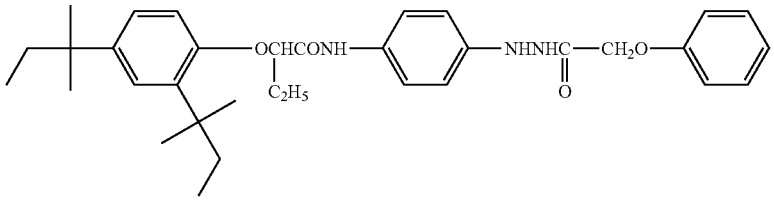
(I-12)
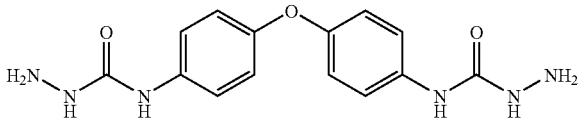
(I-13)
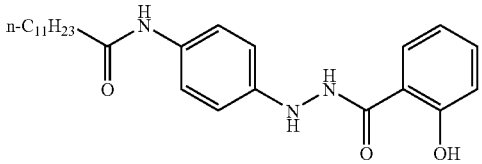
(I-14)
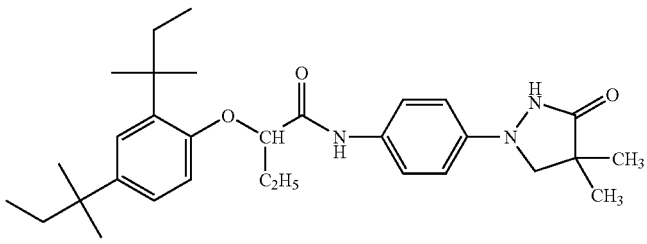

-continued
(I-15)
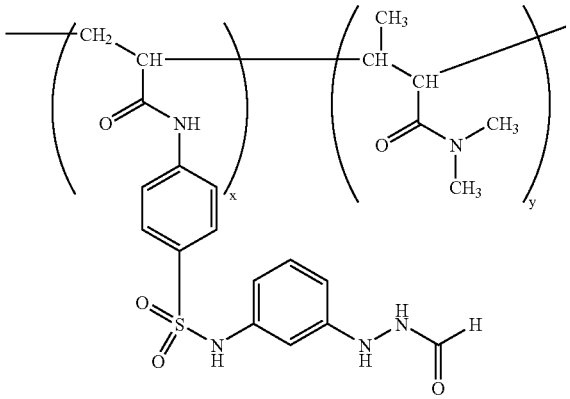
(I-16)
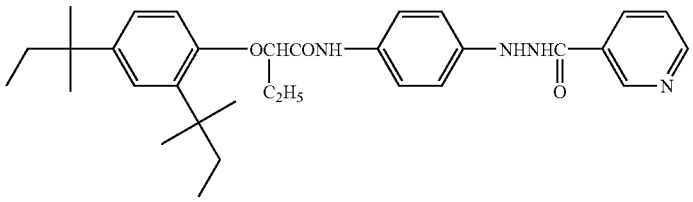
(I-17)
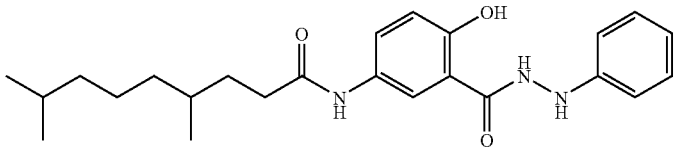
(I-18)
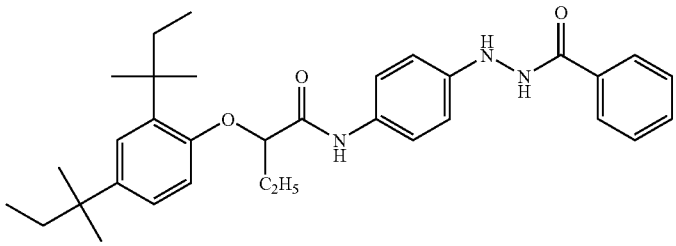
(I-19)
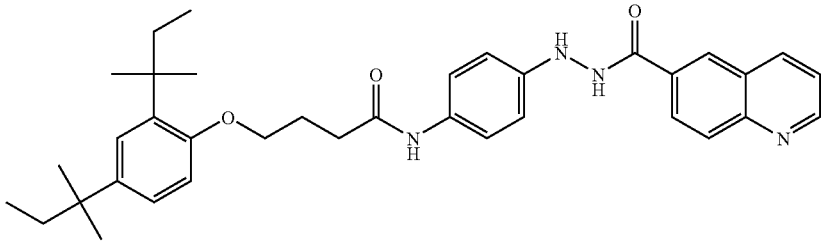
(I-20)
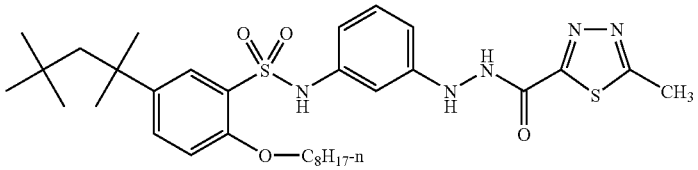

-continued (I-21)

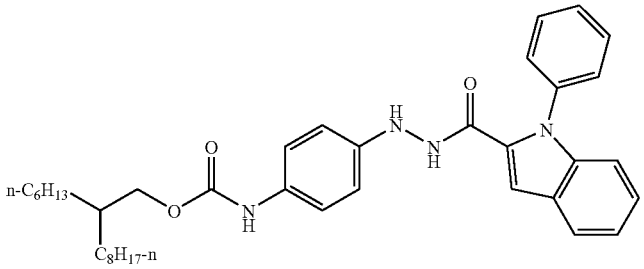

(I-22)

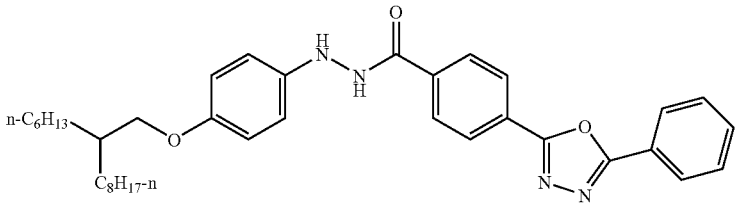

(I-23)

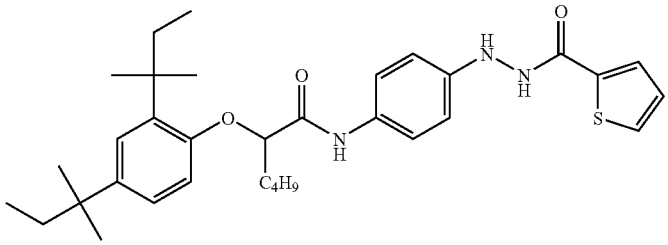

(I-24)

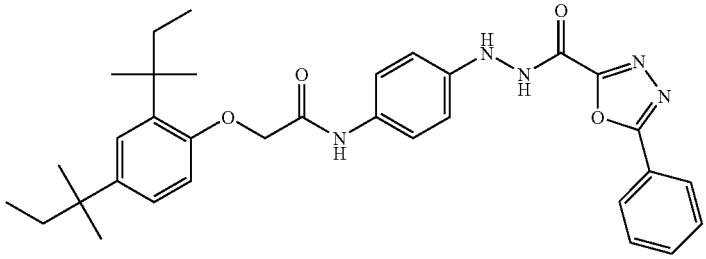

The compound represented by Formula (I) can be easily synthesized by the method as disclosed in JP-A No. 8-262664 and JP-A No. 3-164735, or a method similar to the methods described therein.

In the invention, in addition to the compounds represented by Formula (I), a known antioxidant or the like may be used in combination or may be added to another layer. In the case of the combined use, the molar ratio of the compound of the invention is 50 mole % or more and, more preferably, 70 mole % or more. As the compound to be used in combination, hydroquinone derivatives are preferred, and a compound represented by Formula (II) disclosed in JP-A No. 3-248152 is used preferably.

The compound of the invention can be used while being contained in at least one of the protective layer, the photosensitive silver halide layer, the intermediate layer, the filter layer, the undercoat layer, and the anti-halation layer in the photosensitive material, and is preferably used in an intermediate layer adjacent to the photosensitive emulsion layer and/or for the intermediate layer between two photosensitive emulsion layers (the color sensitivity may be the same or different).

The compound of the invention, when added in the layers, may be added as it is, or may be added while being dissolved in a low boiling point organic solvent which does not exert an influence on a silver halide color photosensitive material such as an alcohol (for example, methyl alcohol). Further, it can be dispersed in or impregnated to a polymer such as a latex, or can be dissolved in a high boiling point organic solvent and emulsified and dispersed in an aqueous gelatin solution. Alternatively, the compound can be dispersed in the form of a powder in.

Examples of the high boiling point organic solvent to be used include phthalate esters (for example, dibutyl phthalate, dioctyl phthalate, dicyclohexyl phthalate, di-2-ethylhexyl phthalate, decyl phthalate, bis(2,4-di-tert-amylphenyl) isophthalate, bis(1,1-diethylpropyl)phthalate, etc.), phosphate esters or phosphonate esters (for example, diphenylphosphate, triphenylphosphate, tricresyl phosphate, 2-ethylhexyl diphenylphosphate, dioctylbutyl phosphate, tricyclohexyl phosphate, tri-2-ethylhexyl phosphate, tridodecylphosphate, di-2-ethylhexylphenylphosphate, etc.), benzoate esters (for example, 2-ethylhexyl benzoate, 2,4-dichlorbenzoate, dodecylbenzoate, 2-ethylhexyl-p-hydroxybenzoate), amides (for example, N,N-diethyldodecane amide, N,N-diethyl laurylamide, N,N,N',N'-tetrakis(2-ethylhexyl)isophthalic acid amide, N,N,N',N'-tetrakis cyclohexyl isophthalic acid amide, ortho-hexadecyloxybenz amide, etc.) or compounds as described in JP-A Nos. 2000-29159, 2001-281821, 2002-40606 8-110624, alcohols (for example, isostearyl alcohol and oleyl alcohol), aliphatic esters (for example, dibuthocyethyl succinate, di-2-ethylhexyl succinate, 2-hexyldecyl tetradecanoate, tributyl citrate, diethyl azelate, stearyl lactate, trioctyltocylate, etc.), aniline derivatives (for example, N,N-dibutyl-2-butoxy-5-tert-octylaniline, etc.), chlorinated paraffins (for example, paraffins of 10% to 80% chlorine content), trimesic acid esters (for example, tributyl trimesate), dodecylbenzene, diisopropyl naphthalene, phenols (for example, 2,4-di-tert-amylphenyl, 4-dodecyloxyphenol, 4-dodecyloxycarbonylphenol, 4-(4-dodecyloxyphenyl sulfonyl)phenol, etc.), carboxylic acids (for example, 2-(2,4-di-tert-amylphenoxy butyric acid, 2-ethoxyoctane decanoic acid, etc.), alkyl phosphoric acids (for example, di-(2-ethylhexyl)phosphoric acid, diphenyl phosphoric acid), etc.

Other than the high boiling point solvents described above, compounds as described in JP-A No. 6-258803 can be used as a high boiling point solvent.

In addition, steps and effects for the latex dispersion method as one of polymer dispersion methods, and specific examples of the latex used for immersion are described in U.S. Pat. No. 4,199,363, West German Patent Application (OLS) Nos. 2,541,274 and 2,541,230, JP-B No. 53-41091 and EP No. 029104, and dispersion by the organic solvent soluble polymer is described in the pamphlet of PCT WO 88/00723.

As an auxiliary solvent, an organic solvent having a boiling point of 30° C. or higher and about 160° C. or lower (for example, ethyl acetate, butyl acetate, ethyl propionate, methyl ethyl ketone, cyclohexanone, 2-ethoxyethyl acetate, dimetylformamide, methanol or ethanol) may be used in combination.

In the invention, as an inter-image effect control means other than the IIE providing layer according to the invention, a plurality of silver halide emulsion layers are arranged such that iodide ions can be moved between the emulsion layers during development, in the same manner as in the method conducted generally in the color photosensitive material, and the silver iodide content, the emulsion grain size, the shape of the emulsion grain and the emulsion coating amount for each of the silver halide emulsions are optimized to obtain an inter-image effect. In the invention, such inter-image effect controlling means may also be used in combination.

As one of the inter-image effect control means, it is preferred to use silver halide grains fogged at the surface and/or inside in at least one layer of color sensitive emulsion layer unit and/or in at least one layer of layers adjacent to a color sensitive emulsion layer unit. The color sensitive emulsion layer unit also includes an auxiliary layer disposed between each of color sensitive emulsion layers having the same color sensitivity. In the invention, the silver halide grains fogged at the surface and/or inside means silver halide grains fogged at the surface and/or inside of the grains by a chemical method or with light so that the grains become developable irrespective of exposure.

The silver halide grains fogged at the surface (surface-fogged silver halide grain) can be prepared by fogging the silver halide grains by a chemical method or with light during grain formation and/or after grain formation of the silver halide. The fogging step can be conducted, for example, by a method of adding a reducing agent or a gold salt under an appropriate condition of pH and pAg, a method of heating under a low pAg condition, or a method of applying uniform exposure. As the reducing agent, stannic a chloride, hydrazine compound, ethanol amine, or thiourea dioxide can be used, for example. The fogging step by the fogging substance described above is preferably carried out before the water washing step, for example, for the purpose of preventing fog increase with time due to diffusion of the fogging substance to the photosensitive emulsion layer.

On the other hand, silver halide grains fogged in the inside of the grains (internally fogged-silver halide grains) can be prepared by using the surface-fogged silver halide grains as a core and forming shells to the surface of the grains. The internally-fogged silver halide is described specifically in JP-A No. 59-214852. The effect to the sensitizing treatment of the internally fogged silver halide grains can be controlled by controlling the thickness of the shell. Further, the internally fogged silver halide grains can also be formed by using the fogging method described above from the initial stage of forming the grains, forming the fogged core and then attaching a not-fogged shell to the fogged core. Depending on the requirement, it is also possible to apply fogging from the inside to the surface of the grains entirely.

As one of the inter-image effect control means, colloidal silver is preferably used in at least one layer of the color sensitive emulsion layer units and/or in at least one layer adjacent to the color sensitive emulsion layer unit. While the colloidal silver may be yellow, blown, or black, it preferably exhibits yellow with a maximum absorption wavelength from 400 nm to 500 nm and, more preferably, it exhibits yellow from 430 nm to 460 nm. Preparation of various types of colloidal silver is described, for example, in Colloidal Elements (Yellow Colloidal Silver by dextrin reducing method of Carey Lea), written by Wiser, published from Wiley & Sons, New York in 1933, or German Patent No. 1,096,193 (blown or black colloidal silver) or in U.S. Pat. No. 2,688,601 (blue colloidal silver). In the invention, the amount of colloidal silver to be used is, preferably, from 0.001 to 0.4 $g/m^2$ and, more preferably, from 0.003 to 0.3 $g/m^2$ per each layer to which the colloidal silver is added.

In the invention, the silver halide grains fogged at the surface and/or in the inside of the grains, or colloidal silver may be contained in any of color sensitive emulsion layer units or the layer adjacent to the color sensitive emulsion layer unit and it is preferably contained in at least one layer of all color sensitive emulsion layer units and/or in at least one adjacent layer of all color sensitive emulsion layer units. The surface fogged silver halide grains, internally fogged silver halide grains, colloidal silver may be used each alone or may be used in combination. The surface fogged silver halide grains and colloidal silver are preferably contained in the layer adjacent to the color sensitive layer unit. In the case where each of the color sensitive emulsion layer units comprises two or more emulsion layers different from one another in the sensitivity, spectral sensitivity, etc., the surface fogged silver halide grains and colloidal silver are preferably contained in the layer adjacent to the lowest sensitive emulsion layer in each of the color sensitive emulsion layer units. On the other hand, the internally fogged silver halide grains are preferably contained in the color sensitive emulsion layer unit. In the case where each of the color sensitive emulsion layer units comprises two or more emulsion layers different from one another in the sensitivity, spectral sensitivity, etc., the internally fogged silver halide grains are preferably contained in the lowest sensitive emulsion layer of each of the color sensitive emulsion layer units and/or in an emulsion layer at a lower sensitive emulsion layer next to the lowest sensitivity emulsion layer.

As one of the interimage effect control means of the present invention, it is preferable to use an internal latent image type silver halide grain, which mainly forms a latent image in the interior of the grain, in at least one layer of the color-sensitive emulsion layer unit. As the internal latent image type silver halide grain, a core/shell internal latent image type emulsion as described in JP-A No. 63-264740 is preferably used. A method of preparing this core/shell internal latent image type emulsion is described in JP-A No. 59-133542. Although the thickness of a shell of this emulsion is not specifically limited, but it is, preferably, 3 to 40 nm and, most preferably, 5 to 20 nm. When each color-sensitive emulsion layer unit comprises two or more layers which are different from one another in sensitivity, spectral sensitivity and the like, it is preferable that the internal latent image type silver halide grain is contained in at least one of a lowest sensitive emulsion layer and a next-to-lowest sensitive emulsion layer of each color-sensitive emulsion layer unit.

As one of the interimage effect control means of the present invention, it is preferable to allow DIR compounds as described in U.S. Pat. Nos. 3,364,022 and 3,379,529; JP-B Nos. 6-21942 and 6-21943; and JP-A Nos. 4-151144 and 4-359248 to be contained in the color reversal photographic material. These DIR compounds may be added to at least one of a desired emulsion layer and non-photosensitive layer. An amount of such DIR compounds to be added is preferably in the range of from 0.01 millimole/$m^2$ to 0.2 millimole/$m^2$.

As one of the interimage effect control means, it is also preferred to dispose a interimage effect donor layer (CL) having the spectral sensitivity distribution different from the main photosensitive layers of BL, GL and RL described in the specifications of U.S. Pat. Nos. 4,663,271, 4,705,744, and 4,707,436, and JP-A Nos. 62-160448 and 63-89850, the interimage effect donating layer being adjacent to or in the vicinity of the main photosensitive layer.

Applicable various techniques, and inorganic and organic materials usable in the silver halide photographic material and silver halide emulsions used therein are generally those as described in Research Disclosure Item 308119 (1989), Item 37038 (1995), and Item 40145 (1997).

In addition, more specifically, techniques and inorganic and organic materials that can be used in the color photographic photosensitive materials to which the silver halide grain emulsion can be applied are described in the portions of EP436,938A2 and patents cited below.

| Items | Corresponding portions |
|---|---|
| 1) Layer configuration: | page 146, line 34 to page 147, line 25 |
| 2) Silver halide emulsion usable together | page 147, line 26 to page 148 line 12 |
| 3) Yellow coupler usable together | page 137, line 35 to page 146, line 33, and page 149, lines 21 to 23 |
| 4) Magenta coupler usable together | page 149, lines 24 to 28; EP421, 453A1, page 3, line 5 to page 25, line 55 |
| 5) Cyan coupler usable together | page 149, lines 29 to 33; EP432, 804A2, page 3, line 28 to page 40, line 2 |

-continued

| Items | Corresponding portions |
|---|---|
| 6) Polymer coupler | page 149, lines 34 to 38; EP435, 334A2, page 113, line 39 to page 123, line 37 |
| 7) Colored coupler | page 53, line 42 to page 137, line 34, and page 149, lines 39 to 45 |
| 8) Functional coupler usable together | page 7, line 1 to page 53, line 41, and page 149, line 46 to page 150, line 3; EP435, 334A2, page 3, line 1 to page 29, line 50 |
| 9) Antiseptic and mildewproofing agent | page 150, lines 25 to 28 |
| 10) Formalin scavenger | page 149, lines 15 to 17 |
| 11) Other additive usable together | page 153, lines 38 to 47; EP421, 453A1, page 75, line 21 to page 84, line 56, and page 27, line 40 to page 37, line 40 |
| 12) Dispersion method | page 150, lines 4 to 24 |
| 13) Support | page 150, lines 32 to 34 |
| 14) Film-thickness film physical properties | page 150, lines 35 to 49 |
| 15) Color development step | page 150, line 50 to page 151, line 47 |
| 16) Desilvering step | page 151, line 48 to page 152, line 53 |
| 17) Automatic processor | page 152, line 54 to page 153, line 2 |
| 18) Washing-stabilizing step | page 153, lines 3 to 37 |

The silver halide color photographic photosensitive material of the invention is also effective to a film unit with a lens as described in, for example, JP-B No. 2-32615 and JUM-B No. 3-39784.

In the present invention, a transparent magnetic recording layer can be used. The transparent magnetic recording layer usable in the present invention is formed by coating onto a support an aqueous or organic solvent-based coating solution comprising a binder and magnetic particles dispersed therein.

Examples of usable magnetic particles include ferromagnetic iron oxide such as $\gamma$-$Fe_2O_3$, Co-coated $\gamma$-$Fe_2O_3$, Co-coated magnetite, Co-containing magnetite, ferromagnetic chromium dioxide, ferromagnetic metals, ferromagnetic alloys, hexagonal Ba-ferrite, Sr-ferrite, Pb-ferrite and Ca-ferrite. A Co-coated ferromagnetic iron oxide such as Co-coated $\gamma$-$Fe_2O_3$ is preferable. The magnetic particles may have the form of needles, rice grains, spheres, cubes, or plates. The specific surface area in $S_{BET}$ is preferably 20 $m^2$/g or greater, more preferably 30 $m^2$/g or greater. The saturation magnetization ($\sigma s$) of the ferromagnetics is preferably in the range of $3.0\times10^4$ to $3.0\times10^5$ A/m, more preferably $4.0\times10^4$ to $2.5\times10^5$ A/m. The ferromagnetic particles may be surface-treated with silica and/or alumina or with an organic substance. Further, as described in JP-A No. 6-161,032, the ferromagnetic particles may be surface-treated with a silane coupling agent or with a titanium coupling agent. Magnetic particles covered with an inorganic or organic substance and described in JP-A Nos. 4-259,911 and 5-81,652 may also be used in the present invention.

As described in JP-A No. 4-219,569, the binders usable together with the magnetic particles are thermoplastic resins, thermosetting resins, radiation-curable resins, reactive resins, acid-, alkali- or biodegradable polymers, naturally occurring polymers (e.g., cellulose derivatives and derivatives of saccharides) and mixtures thereof. These resins have a Tg in the range of −40 to 300° C. and a weight-average molecular weight in the range of 2,000 to 1,000,000. Preferred examples of the binder include vinyl-based copolymers, cellulose derivatives (e.g., cellulose diacetate, cellulose triacetate, cellulose acetatepropionate, cellulose acetatebutylate and cellulose tripropionate), acrylic resins, and polyvinyl acetal resins. Cellulose di(tri)acetate is particularly preferred. The binder may be hardened by use of a crosslinking agent such as an epoxy-type, aziridine-type or isocyanate-type crosslinking agent. Examples of the isocyanate-type crosslinking agent include isocyantes, such as tolylenediisocyanate, 4,4'-diphenylmethanediisocyanate, hexamethylenediisocyanate, xylylenediisocyanate, a reaction product of any of these isocyanates and polyalcohol (e.g., a reaction produc of tolylenediisocyanate (3 mole) and trimethylol propane (1 mole), and a polyisocyanate produced by a condensation reaction of these isocyanates, all of which are described, for example, in JP-A No. 6-59,357.

As described in JP-A No. 6-35,092, the aforementioned magnetic particles are dispersed in a binder preferably by means of a kneader, a pin-type mill or an annular mill. Use of these dispersing means in combination is also preferable. The dispersants described in JP-A No. 5-88,283 and other known dispersants may be used in order to disperse the magnetic particles in the binder. The thickness of the magnetic recording layer is in the range of 0.1 to 10 μm, preferably 0.2 to 5 μm, and more preferably 0.3 to 3 μm. The ratio of the weight of the magnetic particles to the weight of the binder is preferably in the range of 0.5:100 to 60:100, more preferably 1:100 to 30:100. The amount of the magnetic particles used for coating is in the range of 0.005 to 3 $g/m^2$, preferably 0.01 to 2 $g/m^2$, and more preferably 0.02 to 0.5 $g/m^2$. The transmission yellow density of the magnetic recording layer is preferably in the range of 0.01 to 0.50, more preferably 0.03 to 0.20, and most preferably 0.04 to 0.15. The magnetic recording layer may be formed on the entire surface or in stripes on the reverse side of a photographic support by coating or printing. In forming the magnetic recording layer, there may be employed an air doctor method, a blade method, an air knife method, squeezing, impregnation, reverse roll coating, transfer roll coating, gravure coating, kissing, casting, spraying, dipping, bar coating and extrusion.

The magnetic recording layer may have functions such as enhancement of lubricant property, curling control property, anti-static property, adhesion preventing property, and magnetic head polishing property. Alternatively, another functional layer having these properties may be provided. In these cases, at least one type of the particles is preferably non-spherical inorganic abrasive particles having a Mohs' hardness of 5 or more. The non-spherical inorganic particles are preferably oxide such as aluminum oxide, chromium oxide, silicon dioxide and titanium dioxide, and carbides such as silicon carbide and titanium carbide, and fine powder of diamond. The surface of these abrasives may be treated with a silane coupling agent or titanium coupling agent. These particles may be added to a magnetic recording layer or added to an overcoat layer such as a protective layer and a lubricant layer provided on the magnetic recording layer. As the binders to be used, the aforementioned binders may be used, preferably the same binders as those of the magnetic recording layer. The photosensitive material having a magnetic recording layer is described in U.S. Pat. Nos. 5,336,589, 5,250,404, 5,229,259, 5,215,874, and European Patent No. 466,130.

Next, polyester substrate which can be used in the present invention will be described. The details thereof including photosensitive materials, processing cartridges and examples which will be described photosensitivephotosensitivein JIII Journal of Technical Disclosure No. 94-6,023 (issued on Mar. 15, 1994, The Japan Institution of Invention and Innovation). The polyester is made up of a diol and an aromatic dicarboxylic acid. Examples of the aromatic dicarboxylic acid include 2,6-, 1,5-, 1,4- and 2,7-naphthalenedicarboxylic acid, terephthalic acid, isophthalic acid and phthalic acid. Examples of the diol include diethylene glycol, triethylene glycol, cyclohexanedimethanol, bisphenol A and bisphenol. Examples of polymers formed from theses monomers include homopolymers such as polyethylene terephthalate, polyethylene naphthalate and polycyclohexanedimethanol terephthalate. A polyester containing 2,6-naphthalenedicarboxylic acid in an amount of 50 to 100 mole % is preferred, and polyethylene 2,6-naphthalate is particularly preferred. The average molecular weight of the polyester is in the range of about 5,000 to 200,000. Tg of the polyester is 50° C. or greater, preferably 90° C. or greater.

Next, in order to relax the curling tendency of the polyester support, the polyester support is subjected to a heat treatment at temperatures of from not lower than 40° C. to below Tg, more preferably not lower than (Tg−20)° C. but below Tg). The heat treatment may be carried out at a constant temperature within the above-mentioned range, or it may be carried out while being cooled. The duration of the heat treatment is preferably in the range of 0.1 to 1,500 hours, more preferably 0.5 to 200 hours. The heat treatment may be effected while the support is held in the shape of a roll, or the heat treatment may be effected while the support is transported in a web shape. Electroconductive inorganic particles, such as $SnO_2$ and $Sb_2O_5$, may be applied onto the surface of the support to impart surface roughness so that the surface condition is improved. Further, it is preferable that the support is knurled in such a way that the both side edges of the roll are slightly elevated relative to other parts so that transfer of the cut end mark in the roll core is prevented. Although the heat treatment may be carried out after film forming of the support, after surface treatment, after coating of a back layer (e.g., antistatic agent, lubricating agent or the like) and after coating of an undercoat, the heat treatment is carried out preferably after coating of an anti-static agent.

An ultraviolet absorber may be blended into the polyester. Further, in order to prevent light piping, a dye or pigment commercially available for polyester use under the names of "Diaresin" (from Mitsubishi Chemical Industries, Co., Ltd.) or "Kayaset" (from Nihon Kayaku Co., Ltd.) may be blended into the polyester.

In order to bond the photographic layer to the support, it is preferable that the support be surface-treated. Examples of the surface treatment include a chemical treatment, a mechanical treatment, a corona discharge treatment, a flame treatment, an ultraviolet ray treatment, a high frequency wave treatment, a glow discharge treatment, an activated plasma treatment, a laser treatment, a mixed acid treatment and an ozone-oxidation treatment. Among these surface treatment, an ultraviolet irradiation treatment, a flame treatment, a corona discharge treatment and glow discharge treatment are particularly preferred.

With respect to an undercoating method, an undercoat layer may comprise a single layer or two or more layers. Ttypical examples of the binder for the undercoat layer include copolymers made from monomers, as starting materials, selected from the group consisting of vinyl chloride, vinylidene chloride, butadiene, methacrylic acid, acrylic acid, itaconic acid, maleic anhydride and the like. Other examples of the binder may be polyethylene imine, an epoxy resin, grafted gelatin, nitrocellulose, and gelatin. Examples of the compound that is allowed to swell the support include resorcin and p-chlorophenol. The undercoat layer may contain a gelatin-hardening agent such as chromates (e.g., chromium alum), aldehydes (e.g., formaldehyde and glutaric aldehyde), isocyanates, active halogen compounds (e.g., 2,4-dichloro-6-hydroxy-s-triazine), an epichlorohydrin resin and active vinylsulfonic compounds. Further, the undercoat layer may contain $SiO_2$, $TiO_2$, particles of an inorganic material or particles of a copolymer of polymethyl methacrylate (0.01 to 10 μm) as a matting agent.

It is preferable to use an anti-static agent in the present invention. Polymers which contain carboxylic acid, a carboxylate salt, or a sulfonate salt, cationic polymers, and ionic surfactants may be used as the anti-static agent.

The most preferred anti-static agent is particles of at least one type of crystalline metal oxide fine particle, which have a particle size in the range of 0.001 to 1.0 μm, are selected from the group consisting of ZnO, $TiO_2$, $SnO_2$, $Al_2O_3$, $In_2O_3$, $SiO_2$, MgO, BaO, $MoO_3$ and $V_2O_5$ and have a volume resistivity of $10^7$ Ω·cm or less, preferably $10^5$ Ω·cm or less, or fine particles of a complex oxide thereof, for example, a complex of such as Sb, P, B, In, S, Si, C and the like, or metal oxides in the form of sol and fine particles of a complex oxide thereof. The amount of an anti-static agent present in the photosensitive material is preferably in the range of 5 to 500 mg/$m^2$, more preferably in the range of 10 to 350 mg/$m^2$. The ratio of an electroconductive crystalline oxide or a complex oxide thereof to a binder is preferably in the range of 1/300 to 100/1, more preferably 1/100 to 100/5.

Preferably, the photosensitive material contains a lubricant. For this purpose, it is preferable that a lubricant is contained both in the photosensitive layer and in the back layer. A preferred level of lubricity is in the range between 0.01 and 0.25 inclusive, which is determined in a test comprising sliding the photosensitive material at a rate of 60 cm/min against a stainless steel ball having a diameter of 5 mm (25° C., 60% RH) in terms of a coefficient of dynamic friction. In this test, a value of nearly the same level is obtained even if the stainless steel ball is replaced with a photosensitive layer.

Examples of usable lubricants include polyorganosiloxanes, higher aliphatic acid amides, metal salts of higher fatty acids and esters made up of higher fatty acids and higher alcohols. Examples of the polyorganosiloxanes include polydimethylsiloxane, polydiethylsiloxane, polystyrylmethylsiloxane and polymethylphenylsiloxane. The layer to which the lubricant is added is preferably the outermost emulsion layer or the back layer. Polydimethylsiloxane and an ester having a long alkyl chain are particularly preferred.

Preferably, the photosensitive material of the present invention contains a matting agent. Although the matting agent may be added to either the photosensitive layer or the back layer, it is particularly preferable that the matting agent be added to the outermost layer on the emulsion side. Although the matting agent may be soluble or insoluble in a processing solution, it is preferable to use a combination of a soluble matting agent and an insoluble matting agent in the present invention. Examples of matting agents include particles of polymethyl methacrylate, poly(methyl methacrylate/methacrylic acid) (in a molar ratio of 9/1 or 5/5) and polystyrene. Preferably, the matting agent has a particle diameter in the range of 0.8 to 10 μm. Also, the matting agent preferably has a narrow particle diameter distribution range. It is preferable that 90% or more of the total number of the particles have a diameter falling within the range of 0.9 to 1.1 times the average particle diameter. Meanwhile, in order to enhance the matting effect, it is also preferable to use fine particles having a particle diameter of 0.8 μm or less, together with the matting agent having the above-mentioned particle diameter. Examples of the fine particles include particles of polymethyl methacrylate (0.2 μm), particles of poly(methyl methacrylate/methacrylic acid) (in a molar ratio of 9/1, 0.3 μm), particles of polystyrene (0.25 μm) and colloidal silica (0.03 μm).

A film cartridge, into which the photosensitive material of the present invention may be encased, is explained below. The main material of the film cartridge may be a metal or a synthetic plastic.

Preferred examples of the plastic material include polystyrene, polyethylene, polypropylene and polyphenyl ether. The film cartridge may contain an anti-static agent, examples of which include carbon black, metal oxide particles, surfactants (nonionic, anionic, cationic and betaine surfactants), and polymers. Examples of the cartridges which have been subjected to an antistatic treatment are described in JP-A Nos. 1-312,537 and 1-312,538. The resistivity of the cartridge is preferably $10^{12}$ Ω·cm or less in a condition of 25° C. and 25% RH. Generally, carbon black or a pigment is kneaded into the plastic cartridge in order to impart a light-shielding property thereto. The size of the cartridge may be the 135 size which is currently employed (the diameter of cartridge of the 135 size is 25 mm). In order to use a cartridge in a small-sized camera, a film cartridge having a diameter of 22 mm or less is useful. The volume of the case for the cartridge is 30 $cm^3$ or less, preferably 25 $cm^3$ or less. The weight of the plastics used for a film cartridge is preferably in the range of 5 g to 15 g.

A film cartridge from which a film is fed out by the rotation of a spool may be used in the present invention. A film cartridge may have a structure such that the tip end of the film is housed in the cartridge, and is fed from the port of the film cartridge to the outside by rotating the spool axis in the direction of the feed of the film. These cartridges are described in U.S. Pat. Nos. 4,834,306 and 5,226,613. The photographic film may be a so-called raw film prior to processing, or may be a processed film. The raw film and the processed film may be accommodated in a same cartridge, or may be accommodated separate cartridges, respectively.

The number of layers and the order of layers for the silver halide emulsion layer and/or the non-photosensitive layer are not particularly limited in the photosensitive material of the invention, and can optionally be disposed. The color sensitive emulsion layer unit of the invention preferably comprises two or more separate layers having different sensitivities and particularly preferably comprises three or more separate layers. In a case where the color sensitive emulsion layer unit comprises three or more separate sub-layers having different sensitivities, the ratio of the silver coating amount in each separate sub-layer is preferably from 15 to 45% in the high sensitivity sub-ayer, 20 to 50% in the intermediate sensitivity-sub layer, and 20 to 50% in the low sensitivity layer based on total silver amount of 100% in the color sensitive layers. The silver coating amount in the high sensitivity layer is preferably less than the silver coating amount in the medium and low sensitivity layers. In a case where the color sensitive emulsion layer unit comprises a plurality of separate sub-layers having different sensitivities from each other, it is desirable that the silver iodide content in a sub-layer having a lower relative sensitivity is higher than that of the other sub-layer. In the case where each of the photosensitive emulsion layer units comprises three separate layers having different sensitivities, it is particularly preferable that the silver iodide content in the photosensitive separate sub-layer having a highest sensitivity is lower by 1.0 mole % to 5 mole % than the silver iodide content in the photosensitive separate sub-layer having a lowest sensitivity.

A non-photosensitive layer such as various types of intermediate layers and the like may also be disposed adjacent to the medium, upper and lower layers of the color sensitive emulsion layer unit. The non-photosensitive layer may contain, for example, a coupler or a DIR compound as described in JP-A Nos. 61-43748, 59-113438, 59-113440, 61-20037, 61-20038, and the specifications of U.S. Pat. No. 5,378,590, and they may contain a color mixing preventing agent as used customarily. As described above, various layer constitutions and arrangements can be selected depending on the purpose of each photosensitive material.

The silver coating amount in the photosensitive material of the invention is, preferably, 6.0 g/m$^2$ or less, more preferably, 5.0 g/m$^2$ or less and, most preferably, 4.5 g/m$^2$ or less.

Hereinafter, the present invention will be described with reference to embodiments but is not limited thereto.

EXAMPLES

Example 1

Preparation of Sample 101

Comparative Photosensitive Material in which Conventional Silver Halide Grains are Used (1) Preparation of Triacetyl Cellulose Film Triacetyl cellulose was dissolved (13% by mass) in dichloromethane/methanol=92/8 (mass ratio), and, then, triphenyl phosphate and biphenyldiphenyl phosphate with a mass ratio being 2:1 as plasticizers were added to the resultant solution such that the total amount of the plasticizers came to be 14% relative to triacetyl cellulose and, thereafter, a triacetyl cellulose film was prepared by using a band method according to a normal solvent casting method. Thickness of a support after drying was 97 μm.

(2) Content of Undercoat Layer

Both faces of the thus prepared triacetyl cellulose film were applied with an undercoat by using an undercoat solution having a composition as described below. Numerals show a mass of each component contained per liter of the undercoat solution.

| | |
|---|---|
| Gelatin | 10.0 g |
| Salicylic acid | 0.5 g |
| Glycerin | 4.0 g |
| Acetone | 700 mL |
| Methanol | 200 mL |
| Dichloromethane | 80 mL |
| Formaldehyde | 0.1 mg |
| Water | As required, to make the total up to 1.0 L |

(3) Coating of Back Layer

A back layer as described below was applied onto one surface of the resultant undercoated support.

| | |
|---|---|
| 1st layer | |
| Binder: acid-processed gelatin (isoelectric point 9.0) | 1.00 g |
| Polymer latex: P-2 (average particle diameter 0.1 μm) | 0.13 g |
| Polymer latex: P-4 (average particle diameter 0.2 μm) | 0.23 g |
| Ultraviolet absorbent U-1 | 0.030 g |
| Ultraviolet absorbent U-2 | 0.010 g |
| Ultraviolet absorbent U-3 | 0.010 g |
| Ultraviolet absorbent U-4 | 0.020 g |
| High-boiling point organic solvent Oil-2 | 0.030 g |
| Surfactant W-2 | 0.010 g |
| Surfactant W-4 | 3.0 mg |
| 2nd layer | |
| Binder: acid-processed gelatin (isoelectric point 9.0) | 3.10 g |
| Polymer latex: P-3 (average particle diameter 0.2 μm) | 0.11 g |
| Ultraviolet absorbent U-1 | 0.030 g |
| Ultraviolet absorbent U-3 | 0.010 g |
| Ultraviolet absorbent U-7 | 0.020 g |
| High-boiling point organic solvent Oil-2 | 0.030 g |
| Surfactant W-2 | 0.010 g |
| Surfactant W-4 | 3.0 mg |
| Dye D-2 | 0.10 g |
| Dye D-10 | 0.12 g |
| Potassium sulfate | 0.25 g |
| Calcium chloride | 0.5 mg |
| Sodium hydroxide | 0.03 g |
| 3rd layer | |
| Binder: acid-processed gelatin (isoelectric point 9.0). | 3.30 g |
| Surfactant W-2 | 0.020 g |
| Potassium sulfate | 0.30 g |
| Sodium hydroxide | 0.03 g |
| 4th layer | |
| Binder: lime-processed gelatin (isoelectric point 5.4) | 1.15 g |
| 1:9 copolymer of methacrylic acid and methyl methacrylate (average particle diameter 2.0 μm) | 0.040 g |
| 6:4 copolymer of methacrylic acid and methyl methacrylate (average particle diameter 2.0 μm) | 0.030 g |
| Surfactant W-2 | 0.060 g |
| Surfactant W-1 | 7.0 mg |
| Hardener H-1 | 0.23 g |

(4) Coating of Photosensitive Emulsion Layer

<Preparation of Emulsion A>(Preparation of Emulsion with an Average Sphere Equivalent Diameter of 0.3 μm Having Dislocation Lines)

1) Formation of Grain

An aqueous solution of silver nitrate (containing 20.48 g of silver nitrate in 100 mL) was stirred being kept at 40° C. by a double jet method under stirring in 1.6 liter of an aqueous solution at 30° C. containing 4.3 g of potassium bromide and 2.5 g of a low molecular weight gelatin having an average molecular weight (M) of 20,000. 40 mL of an aqueous solution containing 3 g of silver nitrate and an aqueous solution of potassium bromide and potassium iodide (containing 14.3 g of potassium bromide and 2.7 g of potassium iodide) were added with stirring simultaneously each by 41 mL at a rate of 105 mL/minute. After adding an aqueous gelatin'solution (containing 35.6 g of inert gelatin and 284 mL of water), the temperature was elevated to 58°

C., and an aqueous solution of silver nitrate (containing 2.4 g of silver nitrate) was added for 30 sec and ripened for 5 minutes.

Successively, an aqueous solution (A) of silver nitrate containing 47 g of silver nitrate and an aqueous solution of potassium bromide were added over 20 minutes. In this case, pAg was kept at 8.7.

After lowering the temperature to 40° C., a reducing sensitizer-1, and an iridium salt-1 were added. An aqueous solution (C) of silver nitrate (6.9 g) and an aqueous solution of sodium iodide (6.5 g) were added by a double jet method, and successively, an aqueous solution (B) of silver nitrate containing 166 g of silver nitrate and an aqueous solution of potassium bromide were added while being kept at pAg of 9.2. Rhodium salt-1 was added during the addition. Then, the mixture was cooled to 35° C., and washed with water by a customary flocculation method, to which 77 g of gelatin was added, and adjusted the pH value to 6.2 and pAg value to 8.8. The obtained emulsion contained tabular grains with an equivalent circle diameter of 0.18 μm, the coefficient of variation of the circle equivalent diameter of 10%, an average aspect ratio of 2.3 and an average silver iodide content of 3.5 mole %.

(2) Spectral Sensitization and Chemical Sensitization

The emulsion was heated to a temperature of 62° C., sensitizing dye S-2 at $7.15\times10^{-4}$ mole, S-3 at $6\times10^{-4}$ mole, S-8 at $1.2\times10^{-4}$ mole, and S-13 at $2.2\times10^{-4}$ mole to be described later were added and, after 10 minutes, sodium thiosulfate at $2.6\times10^{-5}$ mole/mole Ag, N,N-dimethyl selenourea at $1.1\times10^{-5}$ mole/mole Ag, potassium thiocyanate at $3.0\times10^{-3}$ mole/mole Ag, and chloroauric acid at $8.6\times10^{-6}$ mole/mole Ag were added. The amount of the sensitizing dye and the amount of the chemical sensitizer, and the time for chemical ripening were controlled such that the sensitivity was highest upon exposure for 1/100 sec. After the chemical ripening, tetrazaindene (hereinafter referred to as TAI) was added at $5\times10^{-4}$ mole/mole Ag as a stabilizer. Further, a sensitizing dye S-1 was added at $0.5\times10^{-4}$ mole. The thus obtained emulsion was referred to as A.

<Preparation of Emulsions B to Q>

Emulsion B to Q were prepared in the same method as that for the preparation of the emulsion A except that the conditions shown in Table 1-(1) to Table 1-(3) are added and changed.

TABLE 1

Constitution of silver Halide Emulsion

Silver iodobromide used in Sample 101

| | | Host grain | | | | Protrusion | | | | | | | | |
|---|---|---|---|---|---|---|---|---|---|---|---|---|---|---|
| Emulsion | Feature | Sphere equivalent average grain size (μm) | Coefficient of variation (%) | Average AgI content (mole %) | Silver bromide content (mole %) | Silver bromide content (mole %) | Silver amount (silver amount to host grains) | Compositional halide structure of silver halide grains | Other features (1) | (2) | (3) | (4) | (5) | (6) |
| A | Average aspect ratio of 2.5 of mono-dispersed (111) tabular grain | 0.18 | 10 | 3.5 | 96.5 | — | — | Triple structure | ○ | ○ | ○ | ○ | — | — |
| B | Average aspect ratio of 3.0 of mono-dispersed (111) tabular grain | 0.20 | 10 | 2.5 | 97.5 | — | — | Quadruple structure | — | — | ○ | — | ○ | — |
| C | Average aspect ratio of 4.5 of mono-dispersed (111) tabular grain | 0.32 | 11 | 3.8 | 96.2 | — | — | Triple structure | — | ○ | — | ○ | ○ | — |
| D | Average aspect ratio of 6.0 of mono-dispersed (111) tabular grain | 0.32 | 21 | 4.8 | 95.2 | — | — | Triple structure | — | ○ | — | ○ | ○ | — |
| E | Average aspect ratio of 6.0 of mono-dispersed (111) tabular grain | 0.48 | 12 | 2.0 | 98.0 | — | — | Quadruple structure | — | ○ | — | — | — | — |
| F | Average aspect ratio of 8.0 of mono-dispersed (111) tabular grain | 0.65 | 12 | 1.6 | 98.4 | — | — | Triple structure | — | ○ | — | — | ○ | — |
| G | Average aspect ratio of 2.5 of mono-dispersed (111) tabular grain | 0.14 | 9 | 3.5 | 96.5 | — | — | Quadruple structure | ○ | — | ○ | ○ | — | — |
| H | Average aspect ratio of 2.8 of mono-dispersed (111) tabular grain | 0.22 | 12 | 1.9 | 98.1 | — | — | Quadruple structure | — | ○ | — | — | ○ | — |
| I | Average aspect ratio of 4.0 of mono-dispersed (111) tabular grain | 0.35 | 12 | 3.5 | 96.5 | — | — | Quintuple structure | ○ | ○ | — | ○ | ○ | — |
| J | Average aspect ratio of 7.0 of mono-dispersed (111) tabular grain | 0.40 | 21 | 2.0 | 98.0 | — | — | Quadruple structure | — | ○ | — | ○ | ○ | — |
| K | Average aspect ratio of 8.5 of mono-dispersed (111) tabular grain | 0.65 | 13 | 1.7 | 98.3 | — | — | Triple structure | ○ | ○ | — | — | ○ | — |

TABLE 1-continued

| Constitution of silver Halide Emulsion | | | | | | | | | | | | | | |
|---|---|---|---|---|---|---|---|---|---|---|---|---|---|---|
| Silver iodobromide used in Sample 101 | | | | | | | | | | | | | | |
| | | Host grain | | | | Protrusion | | | | | | | | |
| Emulsion | Feature | Sphere equivalent average grain size (μm) | Coefficient of variation (%) | Average AgI content (mole %) | Silver bromide content (mole %) | Silver bromide content (mole %) | Silver amount (silver amount to host grains) | Compositional halide structure of silver halide grains | Other features (1) | (2) | (3) | (4) | (5) | (6) |
| L | Average aspect ratio of 2.8 of mono-dispersed (111) tabular grain | 0.30 | 9 | 7.5 | 92.5 | — | — | Triple structure | — | — | ○ | — | ○ | — |
| M | Average aspect ratio of 2.8 of mono-dispersed (111) tabular grain | 0.30 | 9 | 7.5 | 92.5 | — | — | Triple structure | — | ○ | ○ | ○ | — | — |
| N | Average aspect ratio of 3.0 of mono-dispersed (111) tabular grain | 0.35 | 13 | 2.1 | 97.9 | — | — | Quintuple structure | ○ | ○ | — | — | — | — |
| O | Average aspect ratio of 5.0 of mono-dispersed (111) tabular grain | 0.45 | 9 | 2.5 | 97.5 | — | — | Quadruple structure | — | ○ | — | ○ | ○ | — |
| P | Average aspect ratio of 9.0 of mono-dispersed (111) tabular grain | 0.70 | 21 | 2.8 | 97.2 | — | — | Triple structure | ○ | ○ | — | — | ○ | — |
| Q | Average aspect ratio of 9.0 of mono-dispersed (111) tabular grain | 0.85 | 8 | 1.0 | 99.0 | — | — | Quadruple structure | ○ | ○ | — | — | ○ | — |

(Other features)
(1) A reducing sensitizer was added during grain formation.
(2) A selenium sensitizer was used as an after-ripening chemical.
(3) A rhodium salt was added during grain formation.
(4) After an-after-ripening was carried out, a shell was attached to the emulsion grains at that stage by adding 10% silver nitrate and a molar amount of potassium bromide equivalent to the molar amount of silver nitrate.
(5) Presence of dislocation lines by ten or more in average per one grain was observed by a transmission type electron microscope.
(6) Particles having a silver bromide protrusion portion at the apex of a tabular grain occupies 70% or more of the entire grain projection area.
Further, for emulsions B, C, E, H, J, N, Q, R, S, and T, a chemically modified gelatin in which a portion of the amino groups of gelatin was modified with phthalic acid amide was added at the time of the emulsion preparation.

<Spectral Sensitization>

The spectral sensitizer for each emulsion was used in such an amount that the total molar number of covering the surface of the grains per surface area was equivalent to that of the grains of the emulsion A.

TABLE 2

| Spectral sensitization of emulsion | | |
|---|---|---|
| Emulsion | Sensitizing dye added | Addition time of sensitizing dye |
| A | S-1 | After after-ripening |
| | S-2 | Before after-ripening |
| | S-3 | Before after-ripening |
| | S-8 | Before after-ripening |
| | S-13 | Before after-ripening |
| B | S-2 | Before after-ripening |
| | S-8 | Before after-ripening |
| | S-13 | Before after-ripening |
| | S-14 | Before after-ripening |
| C | S-2 | Before after-ripening |
| | S-8 | Before after-ripening |
| | S-13 | Before after-ripening |
| D | S-2 | After after-ripening |
| | S-3 | Before after-ripening |
| | S-8 | Before after-ripening |
| | S-13 | Before after-ripening |
| E | S-1 | Before after-ripening |
| | S-2 | Before after-ripening |
| | S-8 | Before after-ripening |

TABLE 2-continued

| Spectral sensitization of emulsion | | |
|---|---|---|
| Emulsion | Sensitizing dye added | Addition time of sensitizing dye |
| | S-13 | After after-ripening |
| F | S-2 | Before after-ripening |
| | S-3 | Before after-ripening |
| | S-8 | Before after-ripening |
| G | S-4 | After after-ripening |
| | S-5 | After after-ripening |
| | S-12 | After after-ripening |
| H | S-4 | Before after-ripening |
| | S-5 | After after-ripening |
| | S-9 | Before after-ripening |
| | S-14 | After after-ripening |
| J | S-4 | Before after-ripening |
| | S-5 | After after-ripening |
| | S-12 | Before after-ripening |
| K | S-4 | Before after-ripening |
| | S-9 | Before after-ripening |
| | S-12 | Before after-ripening |
| | S-14 | Before after-ripening |
| L, M | S-6 | After after-ripening |
| | S-10 | After after-ripening |
| | S-11 | After after-ripening |
| N | S-6 | After after-ripening |
| | S-7 | After after-ripening |
| | S-10 | After after-ripening |
| | S-11 | After after-ripening |

TABLE 2-continued

| Spectral sensitization of emulsion | | |
|---|---|---|
| Emulsion | Sensitizing dye added | Addition time of sensitizing dye |
| O | S-10 | After after-ripening |
| | S-11 | After after-ripening |
| P | S-6 | After after-ripening |
| | S-7 | After after-ripening |
| | S-10 | Before after-ripening |
| | S-11 | Before after-ripening |
| Q | S-6 | Before after-ripening |
| | S-7 | Before after-ripening |
| | S-10 | Before after-ripening |
| | S-11 | Before after-ripening |

The photosensitive emulsion layers shown below were coated on the side opposite to the side where the back layer was coated, as Sample 101. Numerals represent the addition amount per $m^2$. The effect of the added compounds is not restricted to the described use.

The gelatins used as shown below were a molecular weight (mass average molecular weight) of 100,000 to 200,000. The content of main metal ions was 2500 to 3000 ppm of calcium, 1 to 7 ppm of iron and 1500 to 3000 ppm of sodium. Further, gelatin having a calcium content of 1000 ppm or less was also used together.

The organic compounds to be contained to each of the layers were prepared as emulsified dispersions containing gelatin (W-2 and W-3 were used as the surfactants), and each of the photosensitive emulsions, and the yellow colloidal silver was prepared as gelatin dispersions and coating solutions were prepared by mixing them so as to obtain the described addition amounts and were used for coating. Cpd-H, O, Q, and dyes D-1, 2, 3, 5, 6, 8, 9, and 10, H-1, P-3, F-1 to 9 were dissolved in water or an appropriate water miscible organic solvent such as methanol, dimethyl formamide, ethanol, or dimethyl acetamide and added to the coating solution for each layer.

In each of the thus prepared layers, the gelatin concentration (mass of gelatin solid/volume of coating solution) was within the range from 2.5% to 15.0%, pH of each coating solution was within the range from 5.0 to 8.5, and pAg value in the coating solution of the layer containing the silver halide emulsion when controlled to pH 6.0 and at temperature 40° C. was within the range from 7.0 to 9.5.

After coating, they were dried in a multi-stage drying process in which the temperatures were kept within the range from 10° C. to 450° C. to obtain samples.

| First layer: Antihalation layer | | |
|---|---|---|
| Black colloidal silver | | 0.20 g |
| Gelatin | | 2.20 g |
| Compound CpD-B | | 0.010 g |
| UV light absorber U-1 | | 0.050 g |
| UV light absorber U-3 | | 0.020 g |
| UV light absorber U-4 | | 0.020 g |
| UV light absorber U-5 | | 0.010 g |
| UV light absorber U-2 | | 0.070 g |
| Compound Cpd-F | | 0.20g |
| Compound Cpd-R | | 0.020 g |
| Compound Cpd-S | | 0.020 g |
| High boiling point organic solvent Oil-2 | | 0.020 g |
| High boiling point organic solvent Oil-6 | | 0.020 g |
| High boiling point organic solvent Oil-8 | | 0.020 g |
| Dye D-4 | | 1.0 mg |

-continued

| | | |
|---|---|---|
| Dye D-8 | | 1.0 mg |
| Micro crystallite solid dispersion of dye E-1 | | 0.05 g |
| Second layer: Intermediate layer | | |
| Gelatin | | 0.4 g |
| Compound Cpd-F | | 0.050 g |
| High boiling point organic solvent Oil-6 | | 0.010 g |
| Third layer: Intermediate layer | | |
| Gelatin | | 1.50 g |
| Compound Cpd-M | | 0.10 g |
| Compound Cpd-F | | 0.030 g |
| Compound Cpd-D | | 0.010 g |
| Compound Cpd-K | | 3.0 mg |
| UV light absorber U-6 | | 0.010 g |
| High boiling point organic solvent Oil-6 | | 0.10 g |
| High boiling point organic solvent Oil-3 | | 0.010 g |
| High boiling point organic solvent Oil-4 | | 0.010 g |
| Fourth layer: Low sensitivity red sensitive emulsion layer | | |
| Emulsion A | Amount of silver | 0.05 g |
| Emulsion B | Amount of silver | 0.40 g |
| Emulsion C | Amount of silver | 0.15 g |
| Yellow colloidal silver (Amount of silver) | | 0.1 mg |
| Gelatin | | 0.60 g |
| Coupler C-1 | | 0.11 g |
| Coupler C-2 | | 7.0 mg |
| UV light absorber U-2 | | 3.0 mg |
| Compound Cpd-D | | 1.0 mg |
| Compound Cpd-J | | 2.0 mg |
| High boiling organic solvent Oil-5 | | 0.050 g |
| High boiling organic solvent Oil-10 | | 0.010 g |
| Fifth layer: Medium sensitivity red sensitive emulsion layer | | |
| Emulsion C | Amount of silver | 0.12 g |
| Emulsion D | Amount of silver | 0.12 g |
| Internally fogged silver bromide emulsion (cubic grain with equivalent sphere diameter of 0.11 μm) | Amount of silver | 0.01 g |
| Gelatin | | 0.60 g |
| Coupler C-1 | | 0.16 g |
| Coupler C-2 | | 7.0 mg |
| Compound Cpd-D | | 1.5 mg |
| High boiling point organic solvent Oil-5 | | 0.050 g |
| High boiling point organic solvent Oil-10 | | 0.010 g |
| Compound Cpd-T | | 2.0 mg |
| Sixth layer: High sensitivity red sensitive emulsion layer | | |
| Emulsion E | Amount of silver | 0.32 g |
| Emulsion F | Amount of silver | 0.14 g |
| Fine grain of silver iodobromide (silver iodide content: 0.1 mole %, average equivalent sphere diameter: 0.05 μm) | | |
| Gelatin | | 1.50 g |
| Coupler C-1 | | 0.75 g |
| Coupler C-2 | | 0.025 g |
| Coupler C-3 | | 0.020 g |
| UV light absorber U-1 | | 0.010 g |
| High boiling point organic solvent Oil-5 | | 0.25 g |
| High boiling point organic solvent Oil-9 | | 0.05 g |
| High boiling point organic solvent Oil-10 | | 0.10 g |
| Compound Cpd-D | | 5.0 mg |
| Compound Cpd-L | | 1.0 mg |
| Compound Cpd-T | | 0.020 g |
| Additive P-1 | | 0.010 g |
| Additive P-3 | | 0.030 g |
| Seventh layer: Intermediate layer | | |
| Gelatin | | 0.50 g |
| Additive P-2 | | 0.10 g |
| Dye D-5 | | 0.020 g |
| Dye D-9 | | 6.0 mg |
| Compound Cpd-I | | 0.020 g |
| Compound Cpd-O | | 3.0 mg |
| Compound Cpd-P | | 5.0 mg |
| High boiling point organic solvent Oil-6 | | 0.050 g |
| Eighth layer: Intermediate layer | | |
| Yellow colloidal silver | Amount of silver | 3.0 mg |
| Gelatin | | 1.00 g |

-continued

| | | |
|---|---|---|
| Additive P-2 | | 0.05 g |
| Compound Cpd-A | | 0.050 g |
| Compound Cpd-D | | 0.030 g |
| Compound Cpd-M | | 0.10 g |
| High boiling point organic solvent Oil-3 | | 0.010 g |
| High boiling point organic solvent Oil-6 | | 0.10 g |
| Ninth layer: Low sensitivity green sensitive emulsion layer | | |
| Emulsion G | Amount of silver | 0.07 g |
| Emulsion H | Amount of silver | 0.31 g |
| Emulsion I | Amount of silver | 0.31 g |
| Gelatin | | 1.00 g |
| Coupler C-4 | | 0.013 g |
| Coupler C-5 | | 0.080 g |
| Coupler C-10 | | 0.020 g |
| Compound Cpd-B | | 0.012 g |
| Compound Cpd-G | | 3.0 mg |
| Compound Cpd-K | | 2.4 mg |
| High boiling point organic solvent Oil-2 | | 0.024 g |
| High boiling point organic solvent Oil-5 | | 0.024 g |
| Additive P-1 | | 5.0 mg |
| Tenth layer: Medium sensitivity green sensitive emulsion layer | | |
| Emulsifier I | Amount of silver | 0.15 g |
| Emulsifier J | Amount of silver | 0.28 g |
| Gelatin | | 0.70 g |
| Coupler C-4 | | 0.20 g |
| Coupler C-5 | | 0.10 g |
| Coupler C-6 | | 0.010 g |
| Coupler C-10 | | 0.010 g |
| Compound Cpd-B | | 0.030 g |
| Compound Cpd-U | | 9.0 mg |
| High boiling point organic solvent Oil-2 | | 0.015 g |
| High boiling point organic solvent Oil-5 | | 0.030 g |
| Additive P-1 | | 0.010 g |
| Eleventh layer: High sensitivity green sensitive emulsion layer | | |
| Emulsion K | Amount of silver | 0.30 g |
| Internally fogged silver bromide emulsion layer (cubic grain with average sphere equivalent diameter of 0.11 μm) | Amount of silver | 3.0 mg |
| Gelatin | | 1.20 g |
| Coupler C-4 | | 0.33 g |
| Coupler C-5 | | 0.20 g |
| Coupler C-7 | | 0.10 g |
| Compound Cpd-B | | 0.030 g |
| Compound Cpd-U | | 0.030 g |
| Additive P-1 | | 0.10 g |
| 12th layer: Yellow filter layer | | |
| Yellow colloidal silver | Amount of silver | 2.0 mg |
| Gelatin | | 1.0 g |
| Compound Cpd-C | | 0.010 g |
| Compound Cpd-M | | 0.020 g |
| High boiling point organic solvent Oil-1 | | 0.020 g |
| High boiling point organic solvent Oil-6 | | 0.020 g |
| Solid dispersion of crystallite of dye E-2 | | 0.25 g |
| 13th layer: low sensitivity blue sensitive emulsion layer | | |
| Emulsion L | Amount of silver | 0.07 g |
| Emulsion M | Amount of silver | 0.05 g |
| Emulsion N | Amount of silver | 0.09 g |
| Gelatin | | 0.80 g |
| Coupler C-8 | | 0.050 g |
| Coupler C-10 | | 0.50 g |
| Compound Cpd-B | | 0.020 g |
| Compound Cpd-I | | 10.0 mg |
| Compound Cpd-K | | 1.5 mg |
| UV light absorber U-5 | | 0.015 g |
| Additive P-1 | | 0.020 g |
| 14th layer: Medium sensitivity blue sensitive emulsion layer | | |
| Emulsion N | Amount of silver | 0.08 g |
| Emulsion O | Amount of silver | 0.08 g |
| Gelatin | | 0.65 g |
| Coupler C-8 | | 0.050 g |
| Coupler C-10 | | 0.30 g |

-continued

| | | |
|---|---|---|
| Compound Cpd-B | | 0.010 g |
| Compound Cpd-E | | 0.020 g |
| Compound Cpd-N | | 2.0 mg |
| UV light absorber U-5 | | 0.015 g |
| Additive P-1 | | 0.020 g |
| 15th layer: High sensitivity blue sensitive emulsion layer | | |
| Emulsifier P | Amount of silver | 0.20 g |
| Emulsifier Q | Amount of silver | 0.19 g |
| Gelatin | | 2.00 g |
| Coupler C-8 | | 0.10 g |
| Coupler C-10 | | 1.10 g |
| Coupler C-3 | | 0.010 g |
| High boiling point organic solvent Oil-5 | | 0.020 g |
| Compound Cpd-B | | 0.060 g |
| Compound Cpd-D | | 3.0 mg |
| Compound Cpd-E | | 0.020 g |
| Compound Cpd-F | | 0.020 g |
| Compound Cpd-N | | 5.0 mg |
| UV light absorber U-5 | | 0.060 g |
| Additive P-1 | | 0.010 g |
| 16th layer: First protective layer | | |
| Gelatin | | 0.70 g |
| UV light absorber U-1 | | 0.020 g |
| UV light absorber U-5 | | 0.030 g |
| UV light absorber U-2 | | 0.10 g |
| Compound Cpd-B | | 0.030 g |
| Compound Cpd-O | | 5.0 mg |
| Compound Cpd-A | | 0.030 g |
| Compound Cpd-H | | 0.20 g |
| Dye D-1 | | 8.0 mg |
| Dye D-2 | | 0.010 g |
| Dye D-3 | | 0.010 g |
| High boiling point organic solvent Oil-3 | | 0.040 g |
| 17th layer: Second protective layer | | |
| Colloidal silver | Amount of silver | 2.5 mg |
| Fine grains of silver iodobromide emulsion (equivalent sphere diameter: 0.06 μm, silver iodide content: 1 mole %) | Amount of silver | 0.10 g |
| Gelatin | | 0.80 g |
| UV light absorber U-2 | | 0.030 g |
| UV light absorber U-5 | | 0.030 g |
| High boiling point organic solvent Oil-3 | | 0.010 g |
| 18th layer: Third protective layer | | |
| Gelatin | | 1.00 g |
| Polymethylmethacrylate (average particle size: 1.5 μm) | | 0.10 g |
| 6:4 Copolymer of methylmethacrylate and methacrylic acid (average particle diameter: 1.5 μm) | | 0.15 g |
| Silicone oil SO-1 | | 0.20 g |
| Surfactant W-1 | | 0.020 g |
| Surfactant W-2 | | 0.040 g |

Further, additive F-1 to F-10 were added to all of the emulsion layers in addition to the compostitions described above. In addition to the compositions described above, a gelatin hardening agent H1 and surfactants W-2, W-3, and W-4 for coating and emulsification were further added to each layer. Phenol, 1,2-benzoisothiazoline-3-one, 2-phenoxyethanol, phenetyl alcohol, and p-butyl benzoate were further added as antiseptic and anti-mold agents.

The thickness of the coated layer of the thus prepared Sample 101 in a dried state was 26.5 μm, and the degree of swelling of Sample when swollen with distilled water at 25° C. was 1.88 times.

C-1
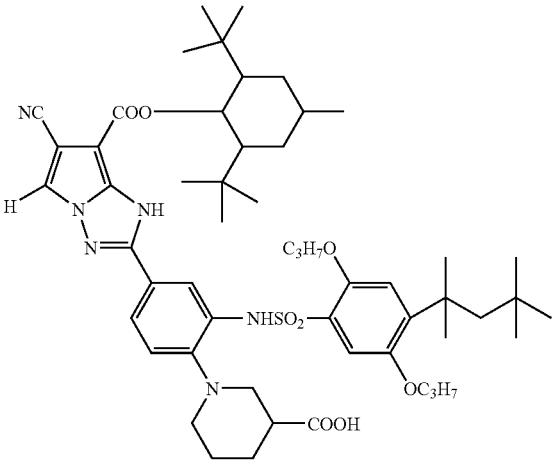
C-2
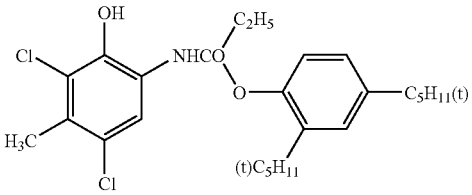
C-3
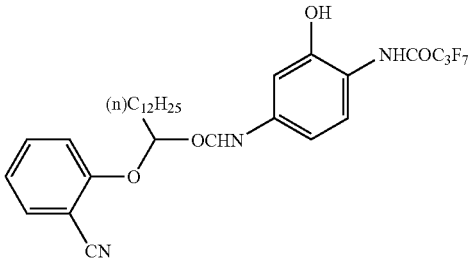
C-4
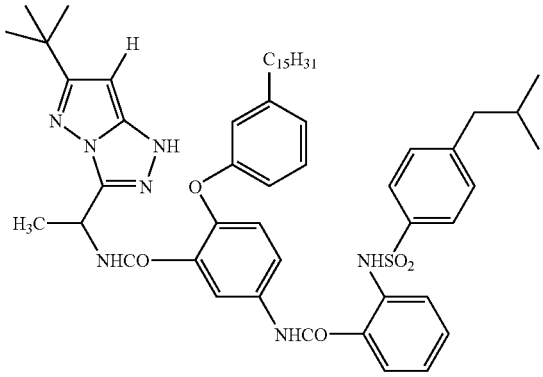
-continued
C-5
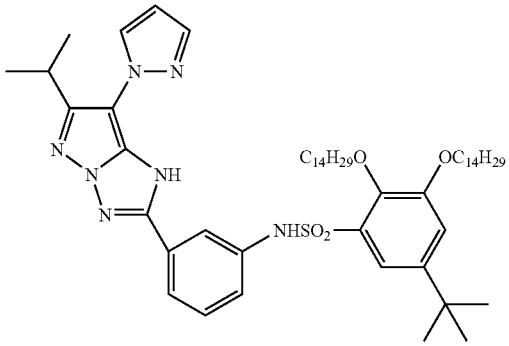
C-6
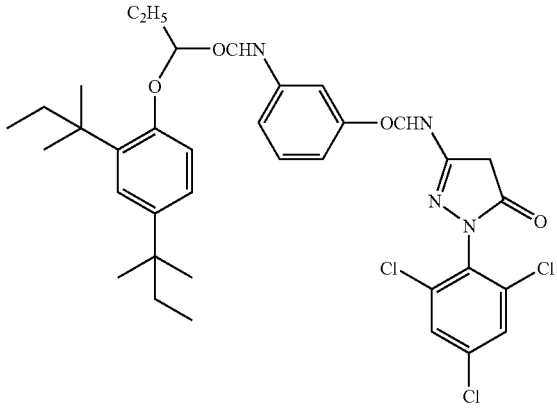
C-7
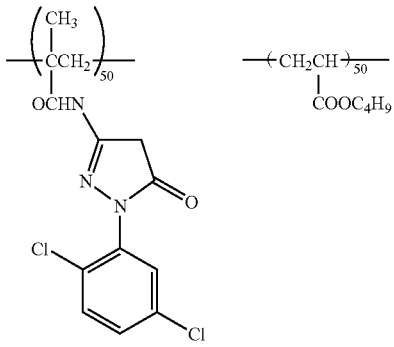

Numerals are % by mass. Average molecular weight is approximately 25,000
(C-8)
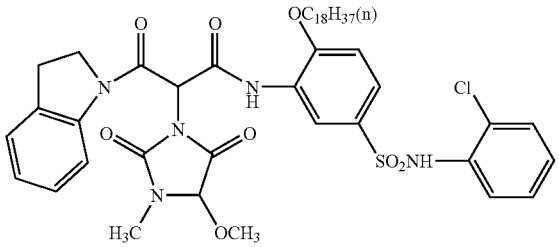
(C-9)
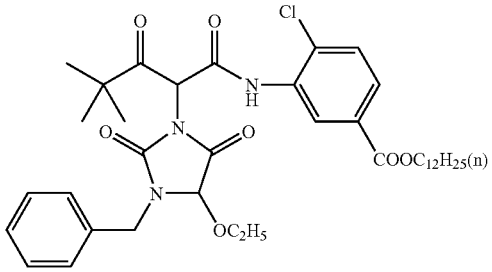
(C-10)
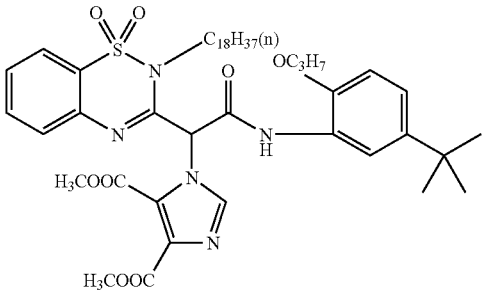
(oil-1)
tri-n-hexyl phosphate
(oil-2)
tricresyl phosphate
(oil-3)
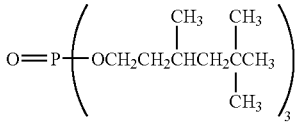
(oil-4)
tricyclohexyl phosphate
(oil-5)
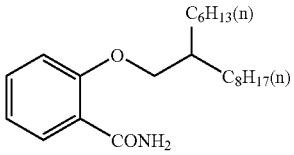
(oil-6)
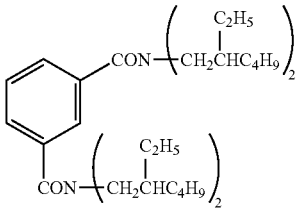

-continued
(oil-7)
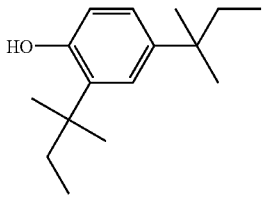
(oil-8)
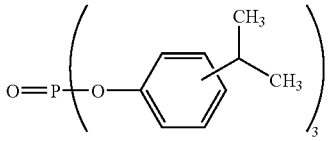
isomer mixture
(oil-9)
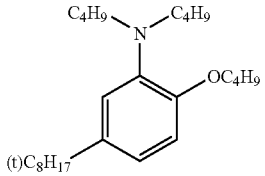
(oil-10)
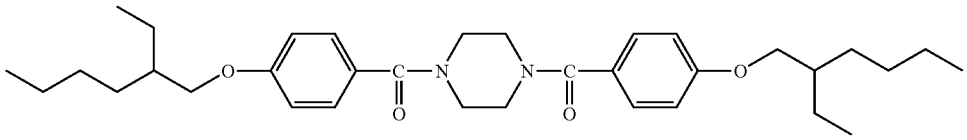
Cpd-A
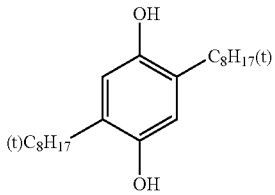
Cpd-B
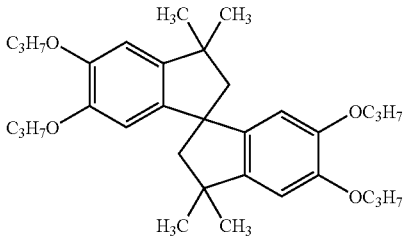
Cpd-C
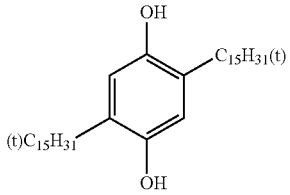
Cpd-D
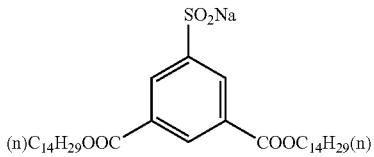

-continued
Cpd-E
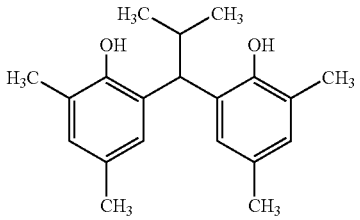
Cpd-F
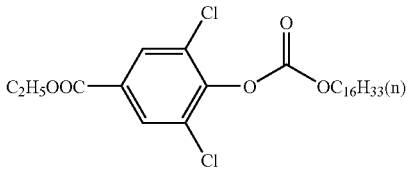
Cpd-G
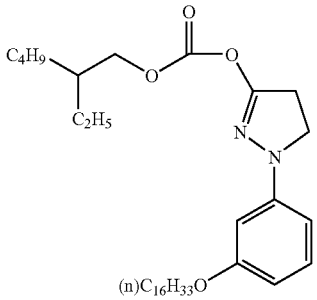
Cpd-H
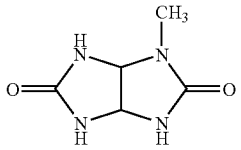
Cpd-I
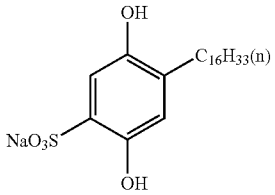
Cpd-J
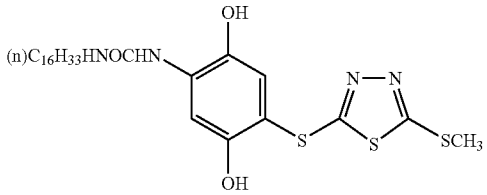
Cpd-K
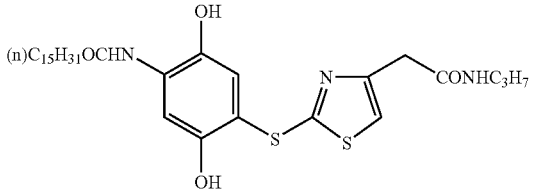

-continued
Cpd-L
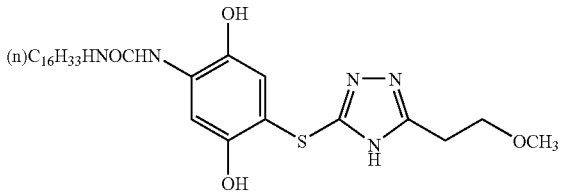
Cpd-M
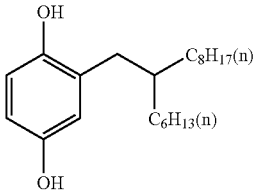
Cpd-N
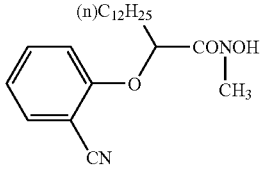
Cpd-O
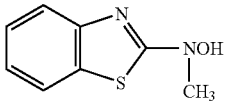
Cpd-P
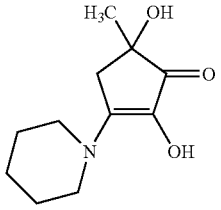
Cpd-Q
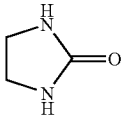
Cpd-R
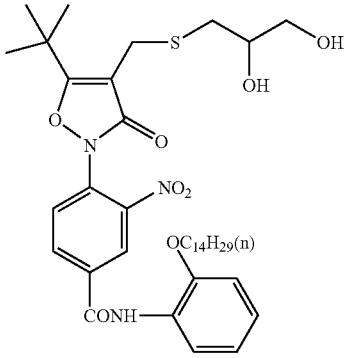

-continued
Cpd-S
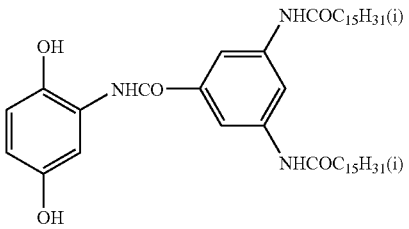
Cpd-T
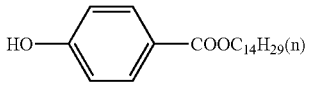
Cpd-U
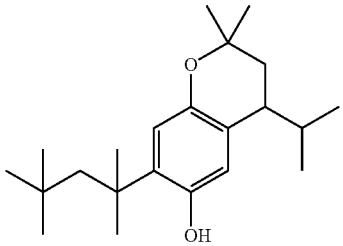
U-1
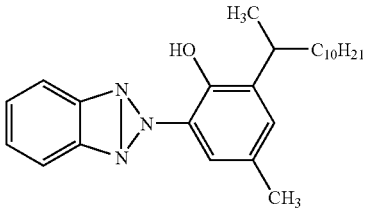
U-2
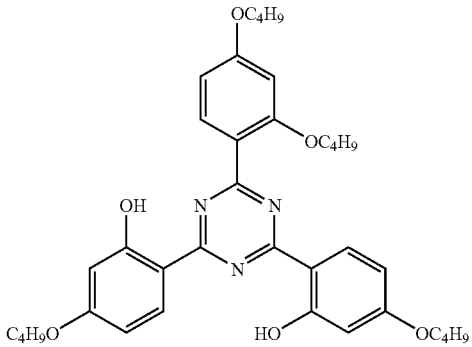
U-3
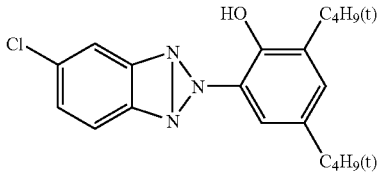
U-4
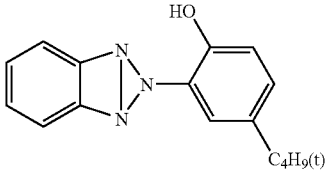

-continued
U-5
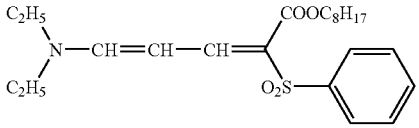
U-6
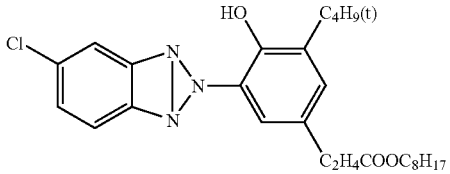
S-1
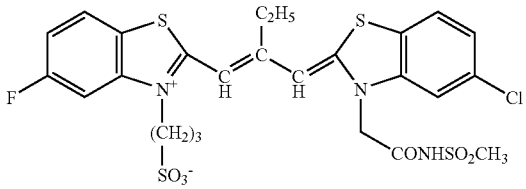
S-2
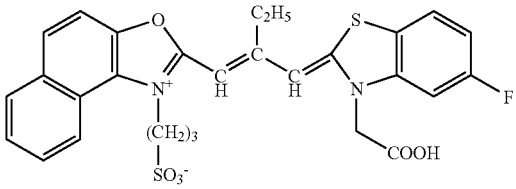
S-3
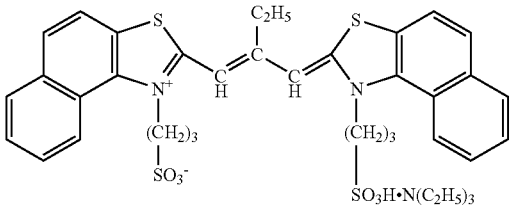
S-4
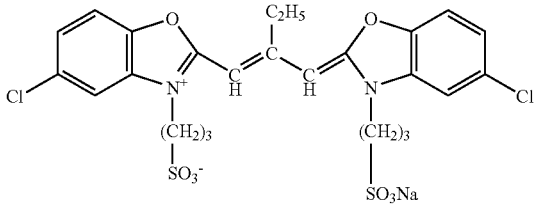
S-5
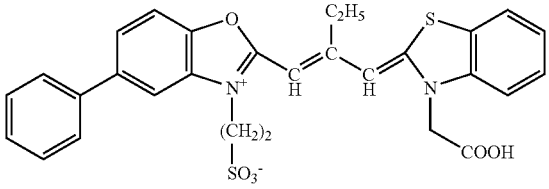
S-6
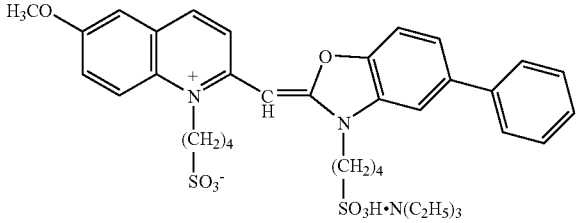

-continued
S-7
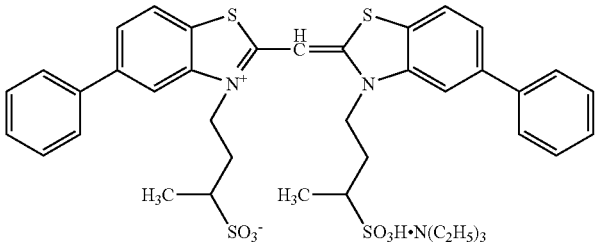
S-8
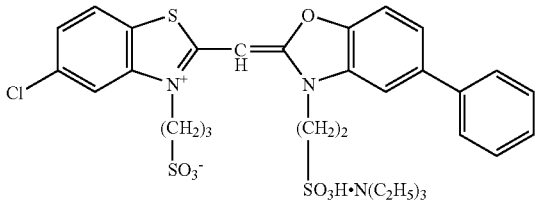
S-9
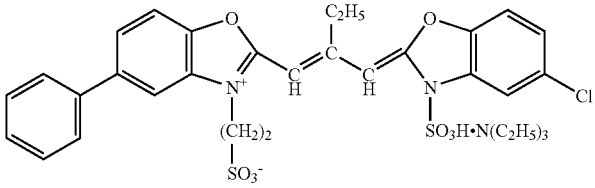
S-10
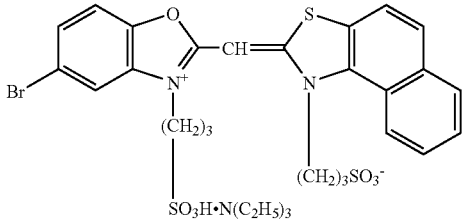
S-11
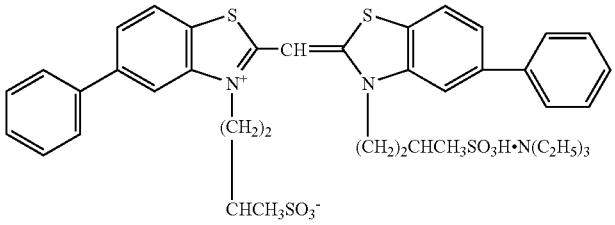
S-12
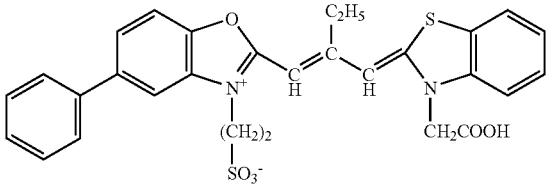
S-13
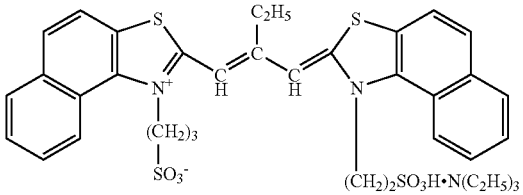

-continued
S-14
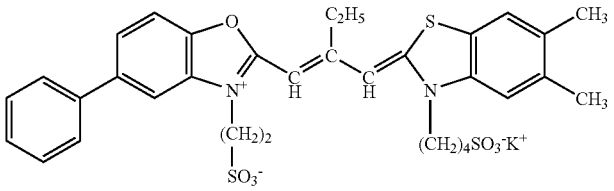
S-15
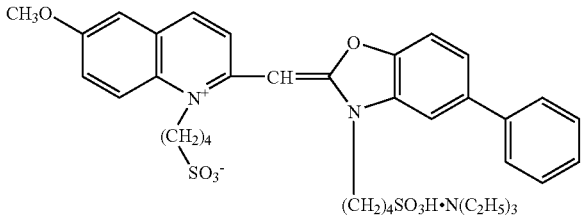
D-1
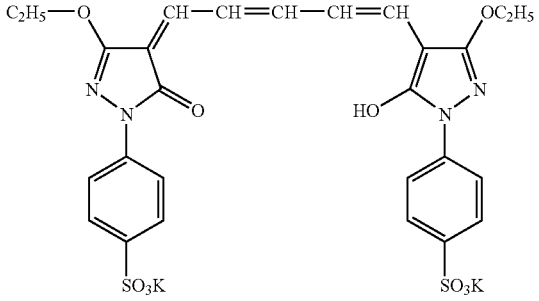
D-2
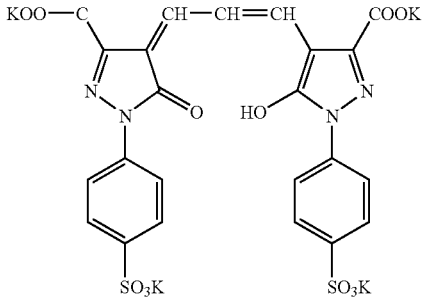
D-3
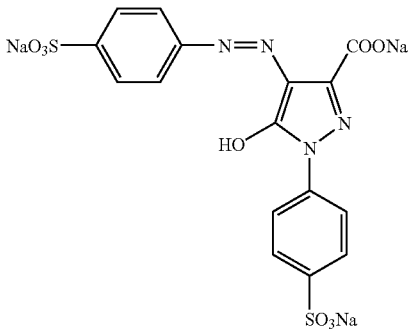

-continued
D-4
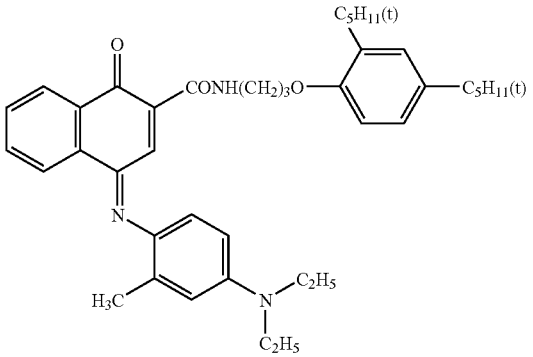
D-5
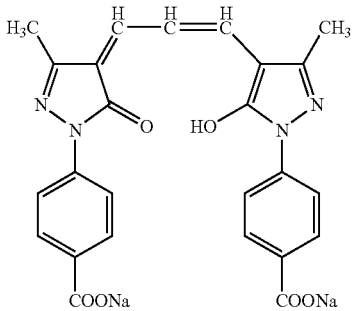
D-6
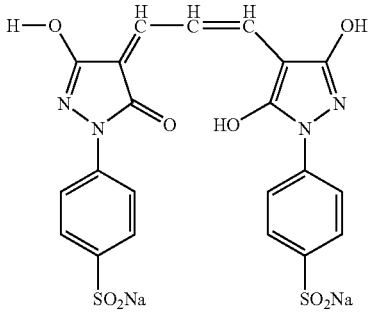
D-7
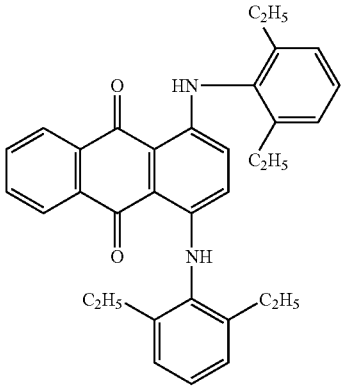

-continued
D-8
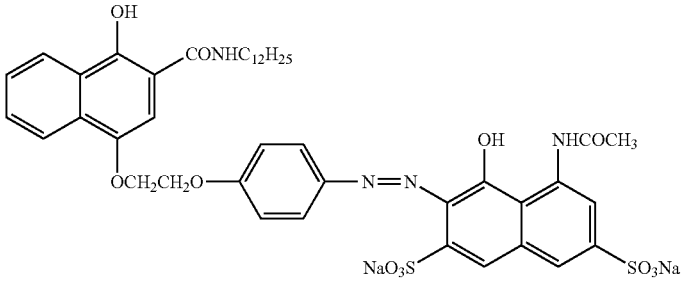
D-9
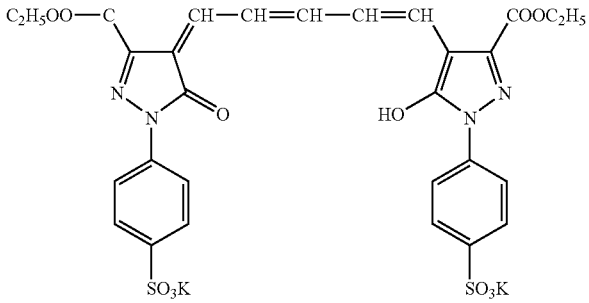
D-10
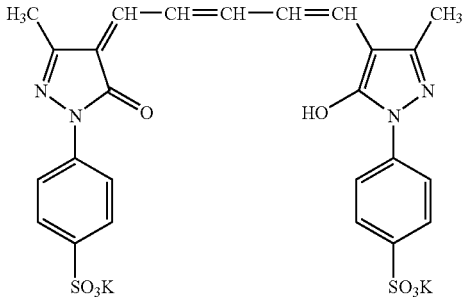
D-11
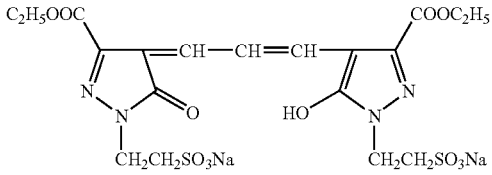
E-1
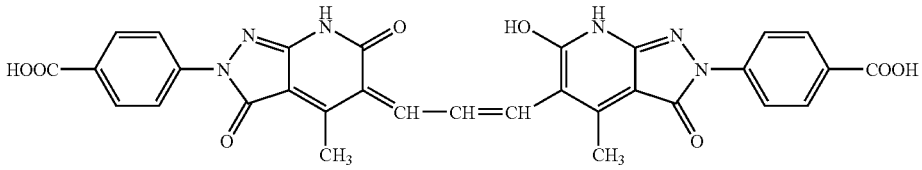

-continued
E-2
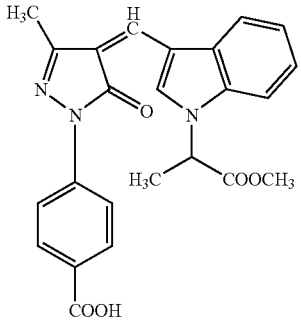
H-1
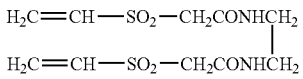
W-1
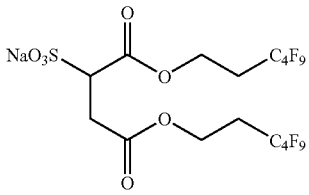
W-2
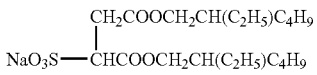
W-3
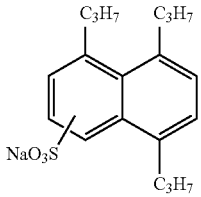
W-4
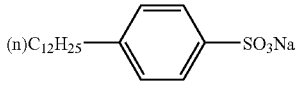
W-5
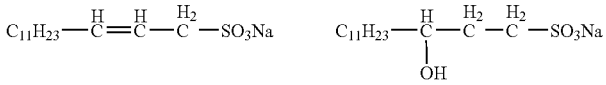
Mixture (60% : 40%)
P-1
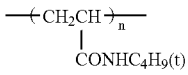
(n = 100 ~ 1000)
P-2
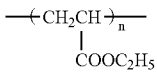
(n = 100 ~ 1000)

-continued
P-3
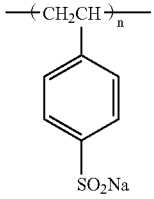
(n = 100 ~ 1000)
P-4
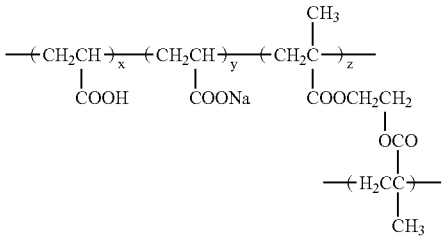
(X : Y : Z = 42. 5 : 7. 5 : 50)
F-1
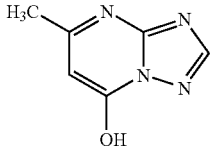
F-2
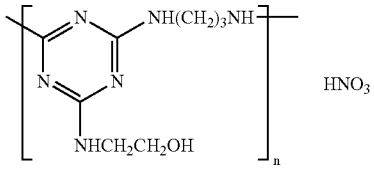
n = 3 ~ 4
F-3
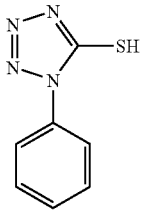
F-4
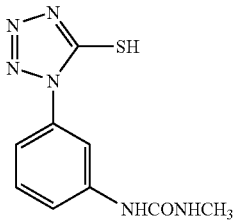
F-5
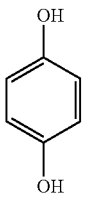

-continued

F-6

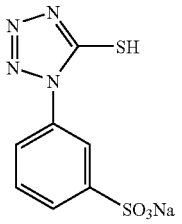

F-7

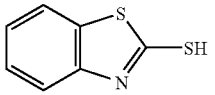

F-8

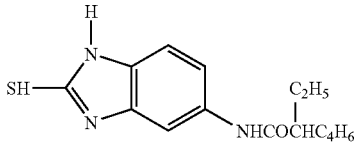

F-9

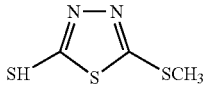

SO-1

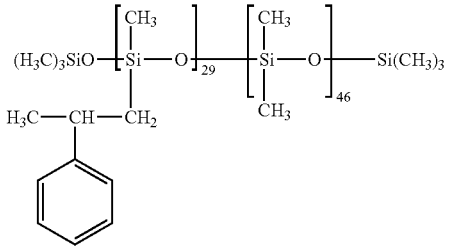

F-10

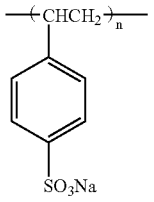

Reducing agent-1

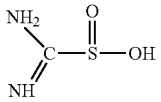

Rhodium salt-1

$K_3[RhCl_6]$

Iridium salt-1

$K_2IrCl_6$

Preparation of Solid Dispersion of Organic Dye (Preparation of Dispersion of Dye E-1)

100 g of PLURONIC F88 (block copolymer of ethyleneoxide-propyleneoxide) manufactured by BASF and water were added to a wet cake of dye E-1 (net weight of E-1 being 270 g), and stirred to make 4,000 g of a slurry. Next, the Ultra Visco Mill (UVM-2) manufactured by Imex K.K. was loaded with 1,700 mL of zirconia beads having an average particle diameter of 0.5 mm, and the slurry was pulverized through the UVM-2 at a peripheral speed of approximately 10 m/sec and a discharge rate of 0.5 L/minute for two hours. The beads were filtered out, and water was added to dilute the resultant mixture to form a dye dispersion having a dye concentration of 3%. Thereafter, the dispersion was heated at 90° C. for 10 hours for stabilization. An average particle diameter of the resultant dye fine particles was 0.30 μm, and the particle diameter distribution (standard deviation of particle diameter×100/average particle diameter) was 20%.

(Preparation of Solid Dispersion of Dye E-2)

Water and 270 g of W-3 were added to 1,400 g of a wet cake of E-2 containing 30% by mass of water, and the resultant mixture was stirred to form a slurry having an E-2 concentration of 40% by mass. Next, the Ultra Visco Mill (UVM-2) manufactured by Imex K. K. was loaded with 1,700 mL of zirconia beads having an average particle diameter of 0.5 mm, and the slurry was pulverized through the UVM-2 at a peripheral speed of approximately 10 m/sec and a discharge rate of 0.5 L/minute for 8 hours, thereby obtaining a solid fine particle dispersion of E-2. This dispersion was diluted to 20% by mass with ion-exchanged water to obtain a solid fine particle dispersion. The average particle diameter was 0.15 μm.

A portion of the resultant Sample 101 was cut into strips, The strips were subjected to the sensitometry including the step of the following development processing A by the method described in this text and, as a result of determining the gravitational center wavelength for the spectral sensitivity distribution of the red sensitive silver halide emulsion layer, green sensitive silver halide emulsion layer, blue sensitive silver halide emulsion layer, they were 619 nm, 548 nm, and 443 nm, respectively. Further, the third layer which is a short wave green sensitive inter-image effect providing layer, and the fourth layer which is a red sensitive inter-image effect providing layer were coated each as a single layer and, as a result of determining the gravitational center wavelength for the spectral sensitivity distribution based on the silver development concentration, it was 522 nm for the short wave green sensitive inter-image providing layer and 652 nm for the red sensitive inter-image effect providing layer. The silver development processing is a development processing of carrying out the first water washing after the following development processing A and then carrying out the fixing and the processing steps after the fixing step, without carrying out the intermediate processing steps therebetween.

(Development Processing A)

Upon evaluation, those from Sample 101 which were not exposed and completely exposed were subjected to a running processing at 1:1 ratio until the supplementing amount reached four times the tank capacity, and thereafter the processing solutions were used.

| Processing step | Time | Temperature | Tank capacity | Replenishing amount |
|---|---|---|---|---|
| First development | 6 min | 38° C. | 12 liter | 2200 mm liter/$m^2$ |
| First water washing | 2 min | 38° C. | 4 liter | 7500 mm liter/$m^2$ |
| Reversal | 2 min | 38° C. | 4 liter | 1100 mm liter/$m^2$ |
| Color development | 6 min | 38° C. | 12 liter | 2200 mm liter/$m^2$ |
| Prebleaching | 2 min | 38° C. | 4 liter | 1100 mm liter/$m^2$ |
| Bleaching | 6 min | 38° C. | 12 liter | 220 mm liter/$m^2$ |
| Fixing | 4 min | 38° C. | 8 liter | 1100 mm liter/$m^2$ |
| Second water washing | 4 min | 40° C. | 8 liter | 7500 mm liter/$m^2$ |
| Final rinsing | 1 min | 25° C. | 2 liter | 1100 mm liter/$m^2$ |

The compositions of the processing solutions were as follows:

| <First developing solution> | <Tank solution> | <Replenishing solution> |
|---|---|---|
| Nitrilo-N,N,N-trimethylene phosphonic acid pentasodium salt | 1.5 g | 1.5 g |
| Diethylenetriamine pentaacetic acid pentasodium salt | 2.0 g | 2.0 g |
| Sodium sulfite | 30 g | 30 g |
| Hydroquinone-potassium monosulfonate | 22 g | 20 g |
| Potassium carbonate | 15 g | 20 g |
| Potassium bicarbonate | 12 g | 16 g |
| 1-phenyl-4-methyl-4-hydroxymethyl 2-3-pyrazolidone | 1.5 g | 2.0 g |
| Potassium bromide | 2.5 g | 1.4 g |
| Potassium thiocyanate | 1.2 g | 1.2 |
| Potassium iodide | 4.0 mg | — |
| Ethylene glycol | 13 g | 15 g |
| Water | as required, to make the total up to 1,000 mL | |
| pH | 9.65 | 9.65 |
| The pH was adjusted by using sulfuric acid or potassium hydroxide. | | |

| <Reversal solution> | <Tank solution> | <Replenishing solution> |
|---|---|---|
| Nitrilo-N,N,N-trimethylene phosphonic acid pentasodium salt | 3.0 g | Same as the tank solution |
| Stannous chloride dehydrate | 1.0 g | Same as the tank solution |
| Sodium hydroxide | 8 g | Same as the tank solution |
| Glacial acetic acid | 15 mL | Same as the tank solution |
| Water as required, to make the total up to | 1,000 mL | Same as the tank solution |
| pH | 6.00 | Same as the tank solution |
| The pH was adjusted by using acetic acid or sodium hydroxide. | | |

| <Color developing solution> | <Tank solution> | <Replenishing solution> |
|---|---|---|
| Nitrilo-N,N,N-trimethylene phosphonic acid pentasodium salt | 2.0 g | 2.0 g |
| Sodium sulfite | 7.0 g | 7.0 g |
| Trisodium phosphate dodecahydrate | 25 g | 25 g |
| Potassium bromide | 1.0 g | — |
| Potassium iodide | 50 mg | — |
| Sodium hydroxide | 10.0 g | 10.0 g |
| Citrazinic acid | 0.5 g | 0.5 g |
| N-ethyl-N-(β-methanesulfonamidoethyl)-3-methyl-4 aminoaniline ½ sulfuric acid monohydrate | 9.0 g | 9.0 g |
| 3,6-dithiaoctane-1,8-diol | 0.6 g | 0.7 g |
| Water as required, to make the total up to | 1,000 mL | 1,000 mL |
| pH | 11.85 | 12.0 |
| The pH was adjusted by using sulfuric acid or potassium hydroxide. | | |

| <Pre-bleaching solution> | <Tank solution> | <Replenishing solution> |
|---|---|---|
| Ethylenediamine tetraacetic acid disodium salt dihydrate | 8.0 g | 8.0 g |
| Sodium sulfite | 6.0 g | 8.0 g |
| 1-thioglycerol | 0.4 g | 0.4 g |
| Formaldehyde sodium bisulfite adduct | 25 g | 25 g |
| Water as required, to make the total up to | 1,000 mL | 1,000 mL |
| pH | 6.30 | 6.10 |
| The pH was adjusted by using acetic acid or sodium hydroxide. | | |

| <Bleaching solution> | <Tank solution> | <Replenishing solution> |
|---|---|---|
| Ethylenediamine tetraacetic acid disodium salt dehydrate | 2.0 g | 4.0 g |
| Ethylenediamine tetraacetic acid Fe (III) ammonium dihydrate | 120 g | 240 g |

-continued

| | | |
|---|---|---|
| Potassium bromide | 100 g | 200 g |
| Ammonium nitrate | 10 g | 20 g |
| Water as required, to make the total up to | 1,000 mL | 1,000 mL |
| pH | 5.70 | 5.50 |

The pH was adjusted by using nitric acid or sodium hydroxide.

| <Fixing solution> | <Tank solution> | <Replenishing solution> |
|---|---|---|
| Ammonium thiosulfate | 80 g | Same as the tank solution |
| Sodium sulfite | 5.0 g | Same as the tank solution |
| Sodium bisulfite | 5.0 g | Same as the tank solution |
| Water as required, to make the total up to | 1,000 mL | Same as the tank solution |
| pH | 6.60 | |

The pH was adjusted by using acetic acid or ammonia water.

| <Stabilizer> | <Tank solution> | <Replenishing solution> |
|---|---|---|
| 1,2-benzoisothiazoline-3-one | 0.02 g | 0.03 g |
| Polyoxyethylene-p-monononyl phenyl ether (average polymerization degree: 10) | 0.3 g | 0.3 g |
| Polymaleic acid (average molecular weight: 2,000) | 0.1 g | 0.15 g |
| Water as required, to make the total up to | 1,000 mL | 1,000 mL |
| pH | 7.0 | 7.0 |

(2) Sample 102 (Comparative Example)

Sample Prepared by Changing the Silver Halide Emulsion of Sample 101 to Silver Halide Emulsion of the Invention Preparation of Silver Halide Emulsion of the Invention (Emulsion C').

(1) Host Grain Forming Step 1000 milliliter (hereinafter also referred to as "mL" of an aqueous solution containing 1 g of potassium bromide and 3 g of a low molecular weight gelatin with an average molecular weight of 10,000 to 20,000 was kept at 40° C. with stirring. 40 mL of an aqueous solution containing 3 g of silver nitrate and 40 mL of an aqueous solution containing 2.2 g of potassium bromide were added to the aqueous solution over 1 min and 30 sec by a double jet method. Thereafter, the temperature was elevated to 50° C., 22 g of succinated gelatin was added, and $2.0\times10^{-5}$ mole of thiourea dioxide was added thereto with respect to one mole of the host grain silver in order to introduce hole trap zones. 800 mL of aqueous solution containing 133 g of silver nitrate and 900 mL of an aqueous solution containing 99.7 g of potassium bromide and 5.4 g of potassium iodide were added over 40 minutes while accelerating the flow rate by a double jet method. The silver potential was kept at −30 mV relative to a saturated calomel electrode.

(2) Epitaxial Precipitation Step

After the host grain formation step described above, the following step operation was carried out to cause epitaxial precipitation. The temperature was lowered to 40° C., and the silver potential was controlled to +50 mV by adding an aqueous solution of silver nitrate. After adding 100 mL of an aqueous solution of calcium nitrate at 2 M calcium concentration, spectral sensitizing dyes S-2, S-8, and S-13 were added at a molar ratio of 86:7:7 and at a ratio of the saturated coverage amount of 98%.

Then, KSCN was added by $2.0\times10^{-3}$ moles based on 1 mole of silver of the host grain and, successively, 100 mL of an aqueous solution containing 7 g of silver nitrate, and 100 mL of an aqueous solution containing 4.9 g of potassium bromide and 0.5 mg of $K_2[IrCl_6]$ were added at a constant flow rate over 20 minutes by a double jet method to conduct epitaxial precipitation. In this case, the silver potential was kept at +100 mV based on the saturation calomel electrode. The amount of silver used for epitaxial precipitation was 4.4% to the host grains.

(3) Desalting □ Dispersion Step

Desalting was conducted at 35° C. by a known flocculation method, gelatin was added, and 6 cc of an aqueous solution of calcium nitrate at 2M calcium concentration was added to control pH to 5.9 and pAg to 7.3 at 50° C.

(4) Chemical Sensitizing Step

After the emulsion was subjected to chemical sensitization optimally by adding sodium thiosulfate and N-dimethyl selenourea while keeping the emulsion at 50° C. and, a compound F-6 was added by $3.0\times10^{-4}$ mole based on 1 mole of the silver amount for the entire grain, to complete the chemical sensitizing step.

In the thus obtained emulsion C', silver halide grains contained, as host grains, tabular silver bromoiodide grains having an average silver iodide content of 3.8 mole % (average silver bromide content: 96.2 mole %), having 1.1.1-surface as a principal surface, with an average circle equivalent diameter of 0.32 μm, the coefficient of variation of the circle equivalent diameter of 17%, an average thickness of 0.045 μm, and an average aspect ratio of 16, and in which protrusions were formed mainly at the apexes of the host tabular grains occupied 88% of the total projection area. The average halide composition at the protrusion portions had a ratio of 1.5:98.5:0 (mole %) of silver iodide content: silver bromide content: silver chloride content.

Further, when the sensitivity was determined for the emulsion C' based on the definition for the surface sensitivity/total development sensitivity described in the text, respectively, the total development sensitivity was higher than the surface sensitivity. The emulsion C' had an average sphere equivalent diameter equal to that of the emulsion C.

Based on emulsion C', red sensitive emulsions A', B', D', E', and F' having substantially the same sphere equivalent diameter as emulsions A, B, D, E and F, respectively, were prepared by the well-known method while changing the size and the silver iodide content of the emulsions.

Further, based on the emulsions A' to F', the green sensitive emulsions G', H', I', J', and K' of the invention were prepared by using the sensitizing dyes S-4, S-5, S-6, and S9 and controlling the average sphere equivalent diameter and the silver iodide content equal to those of the emulsions G, H, I, J, and K. In the same manner, blue sensitive emulsions L', M', N', O', P', and Q' of the invention having the sphere equivalent diameter equal to the blue sensitive emulsions L, M, N, O, P, and Q of the Sample 101 were prepared.

TABLE 3

| Constitution of silver Halide Emulsion (2) | | | | | | | | | | | | | | |
|---|---|---|---|---|---|---|---|---|---|---|---|---|---|---|
| Silver iodobromide used in Sample 102 | | | | | | | | | | | | | | |
| | | Host grain | | | | Protrusion | | | Other features | | | | | |
| Emulsion | Feature | Sphere equivalent average grain size (μm) | Coefficient of variation (%) | Average AgI content (mole %) | Silver bromide content (mole %) | Silver bromide content (mole %) | Silver amount (silver amount to host grains) | Compositional halide structure of silver halide grains | (1) | (2) | (3) | (4) | (5) | (6) |
| A' | Average aspect ratio of 10 of (111) tabular grains having protrusion portion | 0.18 | 20 | 3.5 | 96.5 | 98.5 | 5.8% | Triple structure | ○ | ○ | ○ | — | — | ○ |
| B' | Average aspect ratio of 10 of (111) tabular grains having protrusion portion | 0.20 | 19 | 2.5 | 97.5 | 98.5 | 5.0% | Triple structure | — | — | — | — | — | ○ |
| C' | Average aspect ratio of 16 of (111) tabular grains having protrusion portion | 0.32 | 17 | 3.8 | 96.2 | 98.5 | 4.4% | Triple structure | — | ○ | — | — | — | ○ |
| D' | Average aspect ratio of 15 of (111) tabular grains having protrusion portion | 0.32 | 18 | 4.8 | 95.2 | 98.5 | 4.0% | Triple structure | — | ○ | — | — | — | ○ |
| E' | Average aspect ratio of 21 of (111) tabular grains having protrusion portion | 0.48 | 13 | 2.0 | 98.0 | 98.5 | 3.2% | Triple structure | — | ○ | — | — | — | ○ |
| F' | Average aspect ratio of 29 of (111) tabular grains having protrusion portion | 0.65 | 12 | 1.6 | 98.4 | 98.5 | 3.0% | Triple structure | — | ○ | — | — | — | ○ |
| G' | Average aspect ratio of 7 of (111) tabular grains having protrusion portion | 0.14 | 21 | 3.5 | 96.5 | 98.5 | 6.0% | Triple structure | ○ | | ○ | — | — | ○ |
| H' | Average aspect ratio of 13 of (111) tabular grains having protrusion portion | 0.22 | 15 | 1.9 | 98.1 | 98.5 | 5.0% | Triple structure | — | ○ | — | — | — | ○ |
| I' | Average aspect ratio of 18 of (111) tabular grains having protrusion portion | 0.35 | 14 | 3.5 | 96.5 | 98.5 | 4.4% | Triple structure | ○ | ○ | — | — | — | ○ |
| J' | Average aspect ratio of 19 of (111) tabular grains having protrusion portion | 0.40 | 13 | 2.0 | 98.0 | 98.5 | 3.5% | Triple structure | — | ○ | — | — | — | ○ |
| K' | Average aspect ratio of 30 of (111) tabular grains having protrusion portion | 0.65 | 12 | 1.7 | 98.3 | 98.5 | 3.0% | Triple structure | ○ | ○ | — | — | — | ○ |
| L' | Average aspect ratio of 12 of (111) tabular grains having protrusion portion | 0.30 | 19 | 7.5 | 92.5 | 98.5 | 4.0% | Triple structure | — | — | ○ | — | — | ○ |
| M' | Average aspect ratio of 12 of (111) tabular grains having protrusion portion | 0.30 | 19 | 7.5 | 92.5 | 98.5 | 4.0% | Triple structure | — | ○ | ○ | — | — | ○ |
| N' | Average aspect ratio of 19 of (111) tabular grains having protrusion portion | 0.35 | 14 | 2.1 | 97.9 | 98.5 | 4.4 | Triple structure | ○ | ○ | — | — | — | ○ |
| O' | Average aspect ratio of 20 of (111) tabular grains having protrusion portion | 0.45 | 12 | 2.5 | 97.5 | 98.5 | 3.5 | Triple structure | — | ○ | — | — | — | ○ |
| P' | Average aspect ratio of 28 of (111) tabular grains having protrusion portion | 0.70 | 11 | 2.8 | 97.2 | 98.5 | 2.8 | Triple structure | ○ | ○ | — | — | — | ○ |
| Q' | Average aspect ratio of 30 of (111) tabular grains having protrusion portion | 0.85 | 8 | 1.0 | 99.0 | 98.5 | 2.2 | Triple structure | ○ | ○ | — | — | — | ○ |

TABLE 4

| Emulsion | Sensitizing dye added | Addition time of sensitizing dye |
|---|---|---|
| A' | S-2 | Just before epitaxial precipitation |
| | S-8 | Just before epitaxial precipitation |
| | S-13 | Just before epitaxial precipitation |

TABLE 4-continued

| Emulsion | Sensitizing dye added | Addition time of sensitizing dye |
|---|---|---|
| B' | S-2 | Just before epitaxial precipitation |
| | S-8 | Just before epitaxial precipitation |
| | S-13 | Just before epitaxial precipitation |

TABLE 4-continued

| Emulsion | Sensitizing dye added | Addition time of sensitizing dye |
|---|---|---|
| C' | S-2 | Just before epitaxial precipitation |
| | S-8 | Just before epitaxial precipitation |
| | S-13 | Just before epitaxial precipitation |
| D' | S-2 | Just before epitaxial precipitation |
| | S-8 | Just before epitaxial precipitation |
| | S-13 | Just before epitaxial precipitation |
| E' | S-1 | Just before epitaxial precipitation |
| | S-2 | Just before epitaxial precipitation |
| | S-3 | Just before epitaxial precipitation |
| F' | S-2 | Just before epitaxial precipitation |
| | S-8 | Just before epitaxial precipitation |
| | S-13 | Just before epitaxial precipitation |
| G' | S-4 | Just before epitaxial precipitation |
| | S-12 | Just before epitaxial precipitation |
| H' | S-4 | Just before epitaxial precipitation |
| | S-12 | Just before epitaxial precipitation |
| I' | S-4 | Just before epitaxial precipitation |
| | S-12 | Just before epitaxial precipitation |
| J' | S-4 | Just before epitaxial precipitation |
| | S-12 | Just before epitaxial precipitation |
| K' | S-4 | Just before epitaxial precipitation |
| | S-12 | Just before epitaxial precipitation |
| L', M' | S-7 | Just before epitaxial precipitation |
| | S-11 | Just before epitaxial precipitation |
| N' | S-7 | Just before epitaxial precipitation |
| | S-11 | Just before epitaxial precipitation |
| O' | S-7 | Just before epitaxial precipitation |
| | S-11 | Just before epitaxial precipitation |
| P' | S-7 | Just before epitaxial precipitation |
| | S-11 | Just before epitaxial precipitation |
| Q' | S-6 | Just before epitaxial precipitation |
| | S-7 | Just before epitaxial precipitation |
| | S-11 | Just before epitaxial precipitation |

The red sensitive emulsions A to F of the Sample 101 were changed to the red sensitive emulsions A' to F' of the invention, the green sensitive emulsions G to K were changed to the green sensitive emulsions G' to K' of the invention, and blue sensitive emulsions L to Q were changed to the blue sensitive emulsions L' to Q' of the invention to prepare Sample 102.

The coating amount of the spectral sensitizing dye of the Sample 102 was 2.8 molar times per unit area relative to Sample 101.

Sample 103 (Invention)

Sample in which an Interimage Providing Layer According to the Invention is Disposed to Sample 102

At first, in Sample 102, the following layers were disposed between the intermediate layer as a second layer and the low sensitivity red sensitive emulsion layer as a third layer.

| | | |
|---|---|---|
| I-1st layer: Shorter wavelength green sensitive inter-image providing layer | | |
| Emulsion R | Amount of silver | 0.03 g |
| Emulsion S | Amount of silver | 0.05 g |
| Emulsion T | Amount of silver | 0.24 g |
| Fine grain silver iodide (average sphere equivalent diameter 0.05 μm) | Amount of silver | 0.005 g |
| Gelatin | | 0.5 g |
| Compound Cpd-M | | 0.030 g |
| High boiling point organic solvent Oil-6 | | 0.030 g |
| High boiling point organic solvent Oil-7 | | 5.0 mg |
| Dye D-7 | | 4.0 mg |
| I-2nd layer: Red sensitive inter-image effect providing layer | | |
| Emulsion U | Amount of silver | 0.14 g |
| Gelatin | | 0.25 g |
| Compound Cpd-M | | 0.010 g |
| High boiling point organic solvent Oil-6 | | 0.010 g |
| High boiling point organic solvent Oil-7 | | 1.7 mg |
| I-3rd intermediate layer | | |
| Gelatin | | 1.50 g |
| Compound Cpd-M | | 0.10 g |
| Compound Cpd-F | | 0.030 g |
| Compound Cpd-D | | 0.010 g |
| Compound Cpd-K | | 3.0 mg |
| UV light absorber U-6 | | 0.010 g |
| High boiling point organic solvent Oil-6 | | 0.10 g |
| High boiling point organic solvent Oil-3 | | 0.010 g |
| High boiling point organic solvent Oil-4 | | 0.010 g |

The emulsions R to U used were prepared by the same method as that of the preparation of emulsion A under the conditions shown in Table 5.

TABLE 5

| | Constitution of silver halide emulsion (3) | | | | | | | | | | | | | |
|---|---|---|---|---|---|---|---|---|---|---|---|---|---|---|
| | Silver iodobromide used in Sample 103 | | | | | | | | | | | | | |
| | | Host grain | | | | Protrusion | | | | | | | | |
| Emulsion | Feature | Sphere equivalent average grain size | Coefficient of variation | Average AgI content (mole %) | Silver bromide content (mole %) | Silver bromide content (mole %) | Silver amount (silver amount to host grains) | Compositional halide structure of silver halide grains | Other features (1) | (2) | (3) | (4) | (5) | (6) |
| R | Average aspect ratio of 5.0 of mono-dispersed (111) tabular grain | 0.4 | 15 | 8.0 | 92.0 | — | — | Quadruple Structure | ▯ | ▯ | — | — | ▯ | — |

TABLE 5-continued

| Constitution of silver halide emulsion (3) | | | | | | | | | | | | | | |
|---|---|---|---|---|---|---|---|---|---|---|---|---|---|---|
| Silver iodobromide used in Sample 103 | | | | | | | | | | | | | | |
| | | Host grain | | | | Protrusion | | | | | | | | |
| E-mul-sion | Feature | Sphere equivalent average grain size | Coefficient of variation | Average AgI content (mole %) | Silver bromide content (mole %) | Silver bromide content (mole %) | Silver amount (silver amount to host grains) | Compositional halide structure of silver halide grains | Other features (1) | (2) | (3) | (4) | (5) | (6) |
| S | Average aspect ratio of 4.0 of mono-dispersed (111) tabular grain | 0.7 | 13 | 12.5 | 87.5 | — | — | Quadruple Structure | — | ▯ | — | — | ▯ | — |
| T | Average aspect ratio of 4.0 of mono-dispersed (111) tabular grain | 0.45 | 13 | 10.5 | 89.5 | — | — | Quadruple Structure | ▯ | ▯ | — | — | ▯ | — |
| U | Average aspect ratio of 3.0 of mono-dispersed (111) tabular grain | 0.5 | 15 | 12.0 | 88.0 | — | — | Quadruple Structure | — | ▯ | — | — | ▯ | — |
| V | Average aspect ratio of 3.0 of mono-dispersed (111) tabular grain | 0.7 | 12 | 12.0 | 88.0 | — | — | Quadruple Structure | — | ○ | — | — | ○ | — |

TABLE 6

| Spectral Sensitization of emulsion | | |
|---|---|---|
| Emulsion | Sensitizing dye added | Addition time of sensitizing dye |
| R | S-15 | After after-ripening |
| | S-4 | After after-ripening |
| S | S-15 | After after-ripening |
| | S-4 | After after-ripening |
| | S-10 | Before after-ripening |
| T | S-6 | Before after-ripening |
| | S-10 | Before after-ripening |
| U | S-2 | Before after-ripening |
| | S-8 | Before after-ripening |
| | S-13 | Before after-ripening |
| V | S-10 | After after-ripening |
| | S-11 | After after-ripening |

Then, the following blue sensitive inter-image effect providing layers were disposed between the yellow filter layer as a 12th layer: and the low sensitivity blue sensitive emulsion layer as a 13th layer: to prepare the Sample 103 of the invention.

II-1st layer: blue sensitive inter-image effect providing layer

| | | |
|---|---|---|
| Emulsion V | silver amount | 0.20 g |
| Gelatin | | 0.40 g |
| High boiling point organic solvent oil-6 | | 0.010 g |
| High boiling point organic solvent oil-7 | | 1.7 mg |

The emulsion V used was prepared by the same method as for the preparation of the emulsion A under the conditions shown in Table 8.

Sample 104 (Comparative Example)

Sample in Wwich the Inter-image Providing Layer of this Invention is Disposed in the Sample 101

The inter-image effect providing layer disposed in the Sample 103 was disposed in Sample 101 in the same manner as in Sample 103.

(Evaluation for Sample)

The Samples 101 to 104 were cut into strips which were subjected to the sensitometry by the following method.

(Evaluation of Sensitivity)

The strips were subjected to the development processing A in conformity with the method described in ISO TC 42 (WG3) IOW 32.

(Evaluation for Granularity)

The samples were uniformly exposed with light and subjected to the development processing A to obtain a virtual density of 1.0. The diffusion transmission density of the processed samples were measured by a micro densitometer with an aperture diameter of 48 μm to obtain the RMS granularity (Evaluation for color saturation). Samples of Samples 101 to 104 were cut each into 60 mm in width to form Blowny sized films (6 cm×9 cm), and loaded into a camera, and a Macbeth Color Chart (24 colors including 6 gray steps) was photographed. The color temperature at 5300° K.

Since differences in the sensitivity and color balance slightly among the samples were found, test photographs were taken previously and after determining the exposure amount such that the visual density of the gray patch of Macbeth color chart No. 22 was 0.85±0.05 and a color compensation amount that the gray chart for each of the samples appeared to be the same gray, photographs were taken. 7 frames of photographs were taken by changing ⅓ stop for each photograph, and frames having a density of the gray chart portion of No. 22 being closest to 0.85 were selected, and the frames were used for image evaluation. For all of the samples, the density at the portion was within 0.85±0.03. The spectral transmittance of photographs to be evaluated obtained by photographing the 24 color portions of the Macbeth chart was measured to determine the color saturation C*i (i=1 to 24) on the ith CIELAB color space. Then, the average color saturation C*ave for each of the samples was determined in accordance with the following formula and indicated by a relative value relative to C*ave for sample 101 being assumed as 100.

(Evaluation of Residual Color)

Two sets of Samples 201 to 209 were prepared for each, and one set of the Samples was exposed with white light to form a minimum density which was obtained by processing by the development processing B which is the same as the development processing A except for the temperature of the second washing was changed to 20° C.

Similarly, the other set of the Samples was exposed under the same condition to form a minimum density which was obtained by processing by the development processing C which is the same as the development processing A except for the temperature of the second washing was changed to 40° C. for 20 minutes.

Thereafter, The densities of both sets (550 nm) were measured and the differences therebetween were defined as the characteristic value. When the value is larger, the sensitizing dye remained in a larger amount in the development processing-B, which is not preferable.

The obtained results are shown in Table 7.

TABLE 7

Summary of evaluation for Samples 101 to 103

| Sample No. | Sensitivity | RMS granularity | Color saturation | Remarks |
|---|---|---|---|---|
| 101 | 104 | 0.093 | 100 | Com. Exam |
| 102 | 390 | 0.090 | 80 | Com. Exam |
| 103 | 385 | 0.089 | 122 | Invention |
| 104 | 100 | 0.093 | 106 | Com. Exam |

The sensitivity of the Sample 102 in which the emulsion was change to the emulsion of the invention was greatly increased as compared with that of Sample 101, and the granularity was also improved. However, the color saturation was degraded. On the other hand, from the comparison between the Samples 101 and 104, remarkable improvement on the color saturation could not be expected even when the inter-image providing layer was disposed regarding the conventional emulsions. In contrast, it is apparent that the image quality and the color reproducibility exhibit preferably developed in the Sample 103 in which the emulsion of the invention and the inter-image providing layer of the invention are disposed.

Example 2

Samples 201 to 209 were prepared by changing Cpd-M in the fourth layer, 9th layer, and 13th layer of Samples 101, 102 and 103 in Example 1, respectively, to the compound represented by Formula (I) according to the invention in an amount equivalent to Cpd-M by mole. The inter-image effect providing layer was disposed in the same manner as in Sample 103 of Example 1.

The results are collectively shown in Table 8.

TABLE 8

Constitution and evaluation result for Samples 201 to 209

| Sample | Change of emulsions A to Q | Provision of inter image effect providing layer | Change of color impurity preventing agent 4th, 9th, 13th layer | Color saturation | Color balance | Remarks |
|---|---|---|---|---|---|---|
| 201 | As described in the specification | None | Cpd-M | 100 | 0.06 | Comp. Exam. |
| 202 | Identical with 102 | None | Cpd-M | 80 | 0.13 | Comp. Exam. |
| 203 | Identical with 102 | None | I-2 | 85 | 0.07 | Invention |
| 204 | As described in the specification | Provided | Cpd-M | 106 | 0.16 | Comp. Exam. |
| 205 | Identical with 102 | Provided | I-2 | 125 | 0.09 | Invention |
| 206 | Identical with 102 | Provided | I-3 | 120 | 0.09 | Invention |
| 207 | Identical with 102 | Provided | I-11 | 121 | 0.09 | Invention |
| 208 | Identical with 102 | Provided | I-16 | 12 | 0.08 | Invention |
| 209 | Identical with 102 | Provided | Cpd-M was changed to 80% with I-2 | 122 | 0.01 | Invention |

The residual color of Sample 202 in which the emulsion of the present invention was used in Sample 201, residual color deteriorated. It is apparent that the Sample 203 in which the compound Cpd-M in the 4th layer, 9th layer, 13th layer of the Sample 202 was changed to the compound of the invention exhibited referred results with a reduced residual color. Further, Sample 204 in which a conventional emulsion was used and the inter-image effect producing layer of the invention was used, remarkable improvement on the color saturation could not obtained and the residual color deteriorated. Samples 205 to 208 in which the emulsion of the present invention was used and the compound Cpd-M in the 4th layer, the 9th layer, and the 13th layer was changed to the compound of the present invention in the same procedure as described above exhibited a great improvement on the residual color, and exerted the effect of the invention. Further, a preferred result is also obtained in Sample 209 in which the color impurity preventing agent of the invention was mixed to such an extent as not impairing the effect of the invention.

According to the invention, it is possible to provide a silver halide color photographic photosensitive material having an excellent sensitivity and granularity, excellent in color reproducibility, and with reduced residual color after processing.

What is claimed is:

1. A silver halide color photographic photosensitive material having, on a support, at least one layer of a blue sensitive emulsion layer unit containing a yellow color forming coupler, a green sensitive emulsion layer unit containing a magenta color forming coupler, and a red sensitive emulsion layer unit containing a cyan color coupler, wherein 70% or more of the total projected area of the entire silver halide grains of at least one kind of silver halide emulsion in at least one silver halide photographic emulsion layer is made of silver halide containing silver halide grains satisfying the following (a) to (c), and the photosensitive material contains at least one inter-image effect providing layer:

(a) the material comprises a tabular silver halide host grain with an aspect ratio of 5 or more having two principal surfaces parallel with each other and a protrusion portion of silver halide epitaxially joined onto the surface of the tabular silver halide host grain, (b) the silver bromide content is 70 mole % or more both for the tabular silver halide host grain and the protrusion portion, and (c) the ratio of the silver amount of the protrusion portion to the silver amount of the tabular silver halide host grain is 12% or less.

2. A silver halide color photographic photosensitive material having, on a support, at least one layer of a blue sensitive emulsion layer unit containing a yellow color forming coupler, a green sensitive emulsion layer unit containing a magenta color forming coupler, and a red sensitive emulsion layer unit containing a cyan color forming coupler, wherein 70% or more of the total projected area of the entire silver halide grains of at least one kind of silver halide emulsion in at least one silver halide photographic emulsion layer is made of silver halide containing silver halide grains satisfying the following (a) to (c), and the photosensitive material contains a compound represented by the following Formula (I):

(a) the material comprises a tabular silver halide host grain with an aspect ratio of 5 or more having two principal surfaces parallel with each other and a protrusion portion of silver halide epitaxially joined on the surface of the tabular silver halide host grain, (b) the silver bromide content is 70 mole % or more both for the tabular silver halide host grain and the protrusion portion, and (c) the ratio of the silver amount of the protrusion portion to the silver amount of the tabular silver halide host grain is 12% or less:

Formula (I)

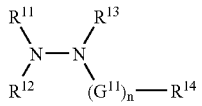

in which $R^{11}$ and $R^{12}$ each independently represent a hydrogen atom, an aliphatic group or aromatic group, $R^{13}$ and $R^{14}$ each represent a hydrogen atom, or one of $R^{13}$ and $R^{14}$ represents a hydrogen atom and the other represents an alkyl group, aralkyl group, aryl group, heterocyclic group, amino group, alkylamino group, arylamino group, alkylthio group, arylthio group, alkoxy group, aryloxy group, alkyl sulfonyl group, aryl sulfonyl group or acyl group, $G^{11}$ represents a carbonyl group, sulfonyl group, sulfinyl group, phospholyl group, oxalyl group, thiocarbonyl group, or iminomethylene group, and n represents 0 or 1 provided that the compound represented by Formula (I) has either a molecular weight of 300 per >N-N< or more and 20,000 or less, or n=1 in Formula (I).

3. A silver halide color photographic material according to claim 1 wherein the silver halide color photographic photosensitive material contains a compound represented by the following Formula (I):

Formula (I)

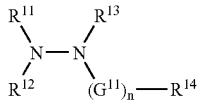

in which $R^{11}$ and $R^{12}$ each independently represent a hydrogen atom, an aliphatic group or aromatic group, $R^{13}$ and $R^{14}$ each represent a hydrogen atom, or one of $R^{13}$ and $R^{14}$ represents a hydrogen atom and the other represents an alkyl group, aralkyl group, aryl group, heterocyclic group, amino group, alkylamino group, arylamino group, alkylthio group, arylthio group, alkoxy group, aryloxy group, alkyl sulfonyl group, aryl sulfonyl group or acyl group, $G^{11}$ represents a carbonyl group, sulfonyl group, sulfinyl group, phospholyl group, oxalyl group, thiocarbonyl group, or iminomethylene group, and n represents 0 or 1, provided that the compound represented by Formula (I) has either a molecular weight of 300 per >N-N< or more and 20,000 or less, or n=1 in Formula (I).

4. A silver halide color photographic photosensitive material according to claim 1, wherein the silver halide color photographic photosensitive material is a silver halide color photographic photosensitive material used for forming a positive image by black and white development after imagewise exposure, followed by subjecting a residual silver halide to color forming development.

5. A silver halide color photographic photosensitive material according to claim 4, wherein the silver iodide content in the silver halide in the inter-image effect providing layer is 1 mole % or more.

6. A silver halide color photographic photosensitive material according to claim 5, wherein the silver halide in the inter-image effect providing layer has a spectral sensitivity to at least one wavelength region in red, green, and blue regions.

7. A silver halide color photographic photosensitive material according to claim 2, wherein the silver halide color photographic photosensitive material is a silver halide color photographic photosensitive material used for forming a positive image by black and white development after imagewise exposure, followed by subjecting a residual silver halide to color forming development.

8. A silver halide color photographic photosensitive material according to claim 7, wherein the silver iodide content in the silver halide in the inter-image effect providing layer is 1 mole % or more.

9. A silver halide color photographic photosensitive material according to claim 8, wherein the silver halide in the inter-image effect providing layer has a spectral sensitivity to at least one wavelength region in red, green, and blue regions.

10. A silver halide color photographic photosensitive material according to claim 3, wherein the silver halide color photographic photosensitive material is a silver halide color photographic photosensitive material used for forming a positive image by black and white development after imagewise exposure, followed by subjecting a residual silver halide to color forming development.

11. A silver halide color photographic photosensitive material according to claim 10, wherein the silver iodide content in the silver halide in the inter-image effect providing layer is 1 mole % or more.

12. A silver halide color photographic photosensitive material according to claim 11, wherein the silver halide in the inter-image effect providing layer has a spectral sensitivity to at least one wavelength region in red, green, and blue regions.

13. A silver halide color photographic photosensitive material according to claim 2, wherein the compound represented by Formula (I) is represented by the following Formula (II):

Formula (II)

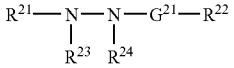

in which $R^{21}$, $R^{22}$, and $G^{21}$ are identical, respectively, with those described for $R^{11}$, $R^{14}$, and $G^{11}$ in Formula (I), and $R^{23}$ and $R^{24}$ each represent a hydrogen atom or one of $R^{23}$ and $R^{24}$ represents a hydrogen atom and the other represents an alkylsufonyl group, an arylsufonyl group, or an acyl group.

14. A silver halide color photographic photosensitive material according to claim 3, wherein the compound represented by Formula (I) is represented by the following Formula (II):

Formula (II)

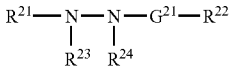

in which $R^{21}$, $R^{22}$, and $G^{21}$ are identical, respectively, with those described for $R^{11}$, $R^{14}$, and $G^{11}$ in Formula (I), and $R^{23}$ and $R^{24}$ each represent a hydrogen atom or one of $R^{23}$ and $R^{24}$ represents a hydrogen atom and the other represents an alkylsufonyl group, an arylsufonyl group, or an acyl group.

15. A silver halide color photographic photosensitive material according to claim 2, wherein the compound represented by Formula (I) is contained in a layer adjacent to the silver halide emulsion layer and/or in an intermediate layer between two silver halide emulsion layers.

16. A silver halide color photographic photosensitive material according to claim 3, wherein the compound represented by Formula (I) is contained in a layer adjacent to the silver halide emulsion layer and/or in an intermediate layer between two silver halide emulsion layers.

17. A silver halide color photographic photosensitive material according to claim 1, wherein the inter-image effect providing layer is a layer which forms no image.

18. A silver halide color photographic photosensitive material according to claim 2, wherein the inter-image effect providing layer is a layer which forms no image.

19. A silver halide color photographic photosensitive material according to claim 1, wherein the silver halide iodide content in the silver halide in the inter-image effect providing layer is 1 mole % or more.

20. A silver halide color photographic photosensitive material according to claim 2, wherein the silver iodide content in the silver halide in the inter-image effect providing layer is 1 mole % or more.

21. A silver halide color photographic photosensitive material according to claim 1, wherein the silver halide in the inter-image effect providing layer has a spectral sensitivity to at least one wavelength region in red, green, and blue regions.

22. A silver halide color photographic photosensitive material according to claim 2, wherein the silver halide in the inter-image effect providing layer has a spectral sensitivity to at least one wavelength region in red, green, and blue regions.

* * * * *